US010987921B2

(12) United States Patent
Iwasaki et al.

(10) Patent No.: US 10,987,921 B2
(45) Date of Patent: Apr. 27, 2021

(54) IMAGE FORMING APPARATUS AND CONTROL METHOD OF IMAGE FORMING APPARATUS

(71) Applicant: CANON KABUSHIKI KAISHA, Tokyo (JP)

(72) Inventors: Ayako Iwasaki, Yokohama (JP); Yoshiyuki Nakagawa, Kawasaki (JP); Yoshihiro Hamada, Yokohama (JP); Masashi Hayashi, Yokohama (JP); Kentaro Muro, Tokyo (JP); Yutaka Kano, Kawasaki (JP); Takahide Takeishi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/354,852

(22) Filed: Mar. 15, 2019

(65) Prior Publication Data

US 2019/0299592 A1 Oct. 3, 2019

(30) Foreign Application Priority Data

Mar. 30, 2018 (JP) ..... JP2018-068665

(51) Int. Cl.
*B41J 2/045* (2006.01)
*B41J 2/18* (2006.01)
(Continued)

(52) U.S. Cl.
CPC ..... *B41J 2/0456* (2013.01); *B41J 2/04508* (2013.01); *B41J 2/04585* (2013.01);
(Continued)

(58) Field of Classification Search
CPC .. B41J 2/04515; B41J 2/0456; B41J 2/04508; B41J 2/04585; B41J 2/04586;
(Continued)

(56) References Cited

U.S. PATENT DOCUMENTS 6,802,584 B2 * 10/2004 Kageyama ..... B41J 2/175 347/14
9,186,896 B2 11/2015 Yoshida
(Continued)

FOREIGN PATENT DOCUMENTS

CN 104890369 A 9/2015
CN 106985518 A 7/2017
(Continued)

OTHER PUBLICATIONS

Extended European Search Report dated Aug. 29, 2019, issued in European Patent Application No. 19161921.2.
(Continued)

*Primary Examiner* — Thinh H Nguyen
(74) *Attorney, Agent, or Firm* — Venable LLP

(57) ABSTRACT

An image forming apparatus 101 capable of performing printing with a high image quality, and a control method of the image forming apparatus 101 are provided. For this purpose, a threshold value Dt is preliminarily set that allows printing without occurrence of blur, for each of preliminarily set monitoring areas A. In the case where a print duty for each of the monitoring areas A has exceeded the threshold value Dt, an ejection frequency of ink and conveying speed of a print medium are reduced in association therebetween.

9 Claims, 19 Drawing Sheets

(51) Int. Cl.
*B41J 2/175* (2006.01)
*B41J 2/14* (2006.01)

(52) U.S. Cl.
CPC ..... *B41J 2/04586* (2013.01); *B41J 2/14145* (2013.01); *B41J 2/175* (2013.01); *B41J 2/17596* (2013.01); *B41J 2/18* (2013.01); *B41J 2002/14459* (2013.01); *B41J 2202/12* (2013.01); *B41J 2202/19* (2013.01); *B41J 2202/20* (2013.01)

(58) Field of Classification Search
CPC .... B41J 2/14145; B41J 2/175; B41J 2/17596; B41J 2002/14459; B41J 2202/12; B41J 2202/19; B41J 2/18; B41J 2202/20
See application file for complete search history.

(56) References Cited

U.S. PATENT DOCUMENTS

| | | | |
|---|---|---|---|
| 9,333,754 | B2 | 5/2016 | Ishii et al. |
| 9,446,593 | B2 | 9/2016 | Yoshida |
| 9,914,308 | B2 | 3/2018 | Yamada et al. |
| 9,931,845 | B2 | 4/2018 | Moriya et al. |
| 9,975,347 | B2 | 5/2018 | Tozuka et al. |
| 10,022,979 | B2 | 7/2018 | Okushima et al. |
| 10,040,288 | B2 | 8/2018 | Moriya et al. |
| 2011/0310152 | A1 | 12/2011 | Muro et al. |
| 2015/0251430 | A1 | 9/2015 | Ishii et al. |
| 2015/0266292 | A1 | 9/2015 | Yoshida |
| 2017/0197412 | A1* | 7/2017 | Kasai ..... B41J 2/155 |
| 2017/0197430 | A1 | 7/2017 | Tozuka et al. |
| 2017/0197439 | A1 | 7/2017 | Okushima et al. |

FOREIGN PATENT DOCUMENTS

| | | | |
|---|---|---|---|
| CN | 107031189 | A | 8/2017 |
| EP | 3 196 027 | A1 | 7/2017 |
| JP | 2016-010862 | A | 1/2016 |
| JP | 2017-124614 | A | 7/2017 |
| JP | 2017-124618 | A | 7/2017 |
| JP | 2017-144701 | A | 8/2017 |
| JP | 2017-197430 | A | 11/2017 |

OTHER PUBLICATIONS

Sep. 3, 2020 Chinese Official Action in Chinese Patent Appln. No. 201910229742.4.

* cited by examiner

IMAGE FORMING APPARATUS AND CONTROL METHOD OF IMAGE FORMING APPARATUS

BACKGROUND OF THE INVENTION

Field of the Invention

The present invention relates to an image forming apparatus configured to eject liquid from liquid ejection heads and to a control method of the image forming apparatus.

Description of the Related Art

In recent years, inkjet print heads, i.e., liquid ejection heads for ejecting liquid ink have been required to suppress print blur due to supply shortage of ink and density non-uniformity due to excessive temperature rise, along with the demand for higher image quality and higher-speed printing. Image blur has been attributed to pressure loss in the flow path for supplying ink to the ejection port.

Japanese Patent Laid-Open No. 2017-124618 has described therein a configuration that divides an ejection part of a liquid ejection head into a plurality of areas; equally sets, from image data, a threshold value in accordance with the area where pressure loss turns out to be the largest; and, in the case where the pressure loss at the time of ejection exceeds the threshold value, controls the ink flow amount so as to reliably supply liquid without causing local liquid supply shortage in the liquid ejection head.

However, in Japanese Patent Laid-Open No. 2017-124618, the effect of pressure loss is calculated from the average flow amount over the areas as a whole, even in the case where the effect of pressure loss differs in each of the plurality of areas, and therefore there is a risk that the print quality may decrease due to supply shortage induced by excessive control of the flow amount, or too little control of the flow amount.

SUMMARY OF THE INVENTION

Therefore, the present invention provides an image forming apparatus capable of performing printing, with high image quality, and a control method of the image forming apparatus.

Therefore, the image forming apparatus of the present invention is an image forming apparatus including an ejection head including a plurality of ejection ports configured to eject liquid; a flow path for supplying liquid to the plurality of ejection ports; and a control unit configured to control the amount of liquid to be ejected from the ejection ports, wherein the apparatus is configured such that a plurality of areas including the ejection ports in the ejection head are set, in accordance with a degree of pressure loss in the flow path, a threshold value, associated with each of the plurality of areas, is set to the amount of ejection per unit time from the ejection ports provided in the areas, and the control unit controls the amount of liquid ejected per unit time to be equal to or smaller than the threshold value for each of the areas.

According to the present invention, it is possible to realize an image forming apparatus capable of performing printing with a high image quality, and a control method of the image forming apparatus.

Further features of the present invention will become apparent from the following description of exemplary embodiments with reference to the attached drawings.

DESCRIPTION OF THE EMBODIMENTS

First Embodiment

Figure 1A:
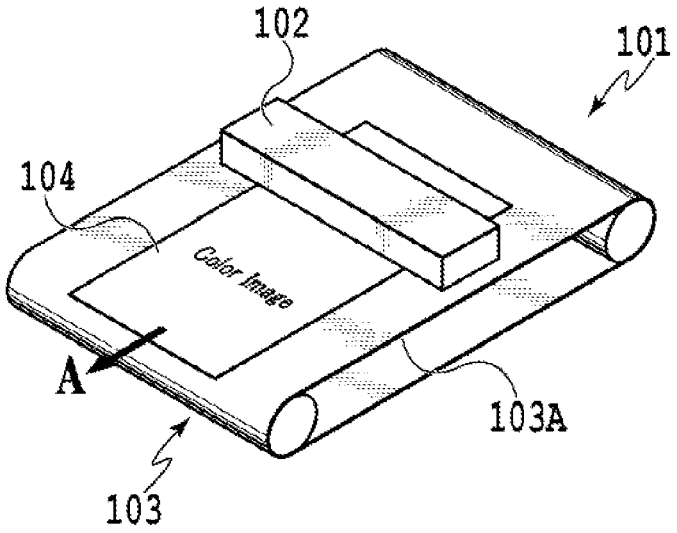
FIG. 1A illustrates a main part of a printing apparatus.

In the following, a first embodiment of the present invention will be described, referring to the drawings.

(Configuration of Printing Apparatus)

Figure 1B:
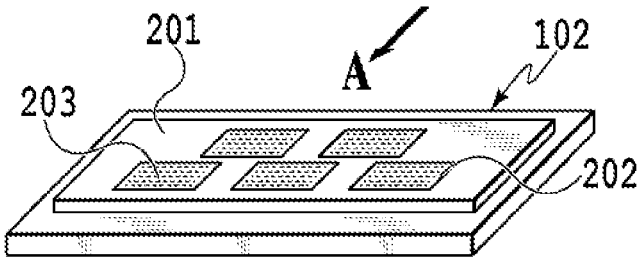
FIG. 1B illustrates a print head.
Figure 1C:
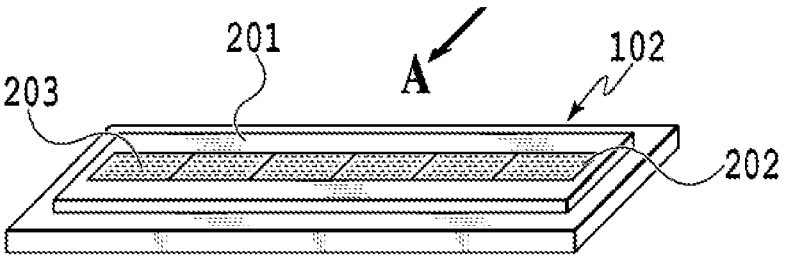
FIG. 1C illustrates a print head.
Figure 1D:
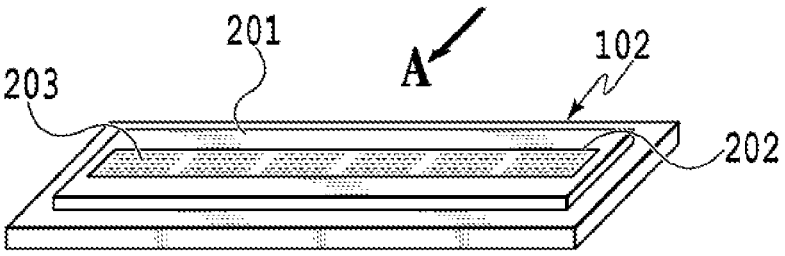
FIG. 1D illustrates a print head.

FIG. 1A is a schematic view illustrating a main part of an inkjet printing apparatus (simply referred to as printing apparatus in the following) 101 to which the present invention is applicable. FIGS. 1B to 1D illustrate a print head. The printing apparatus 101 is a so-called full-line printing apparatus such as that illustrated in FIG. 1A. The printing apparatus 101 has a conveying part 103 configured to convey a print medium 104 in a conveying direction indicated by an arrow A and an inkjet print head (liquid ejection head) 102 capable of ejecting ink.

The conveying part 103 conveys the print medium 104 using a conveying belt 103A. The print head 102, which is a line-type print head extending in a direction intersecting with (perpendicular to, in the case of the present embodiment) the conveying direction of the print medium 104, has a plurality of ejection ports capable of ejecting ink arranged in the width direction of the print medium 104. The print head 102 has ink supplied thereto from an ink tank (not illustrated) capable of storing liquid through an ink supply unit forming an ink flow path. The printing apparatus 101 prints an image on the print medium 104 by ejecting ink from ejection ports of the print head 102, on the basis of print data (ejection data), while continuously conveying the print medium 104. The print medium 104 is not limited to a cut sheet only, and may be an elongated roll sheet, or the like.

Figure 2:
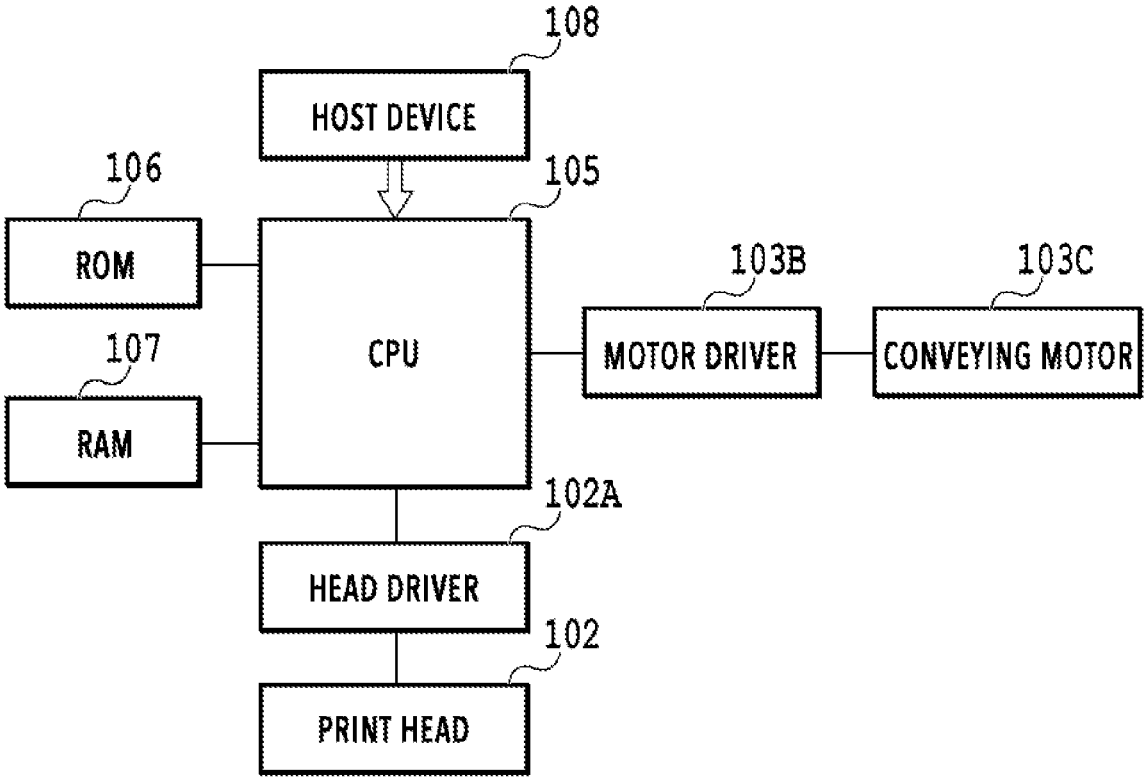
FIG. 2 is a block diagram of a control system of the printing apparatus.

FIG. 2 is a block diagram of a control system of the printing apparatus 101. A CPU 105 performs an operation control process, data processing, or the like, of the printing apparatus 101. A ROM 106 has stored therein programs of such processing procedures, and a RAM 107 is used as a work area for performing such processing. The print head 102 has a plurality of ejection ports, a plurality of ink flow paths in communication with respective ejection ports, a plurality of ejection energy generating elements installed in respective ink flow paths, the plurality of ejection ports capable of ejecting ink being formed thereby.

The ejection ports function as printing elements. Electro-thermal conversion elements or piezoelectric elements may be used as the ejection energy generating elements. In the case of using electro-thermal conversion elements, ink existing in the ink flow path may be foamed by heating of the electro-thermal conversion elements, and the ink may be ejected from the ejection ports using the foaming energy. Ejection of ink from the print head 102 is performed by driving the ejection energy generating elements by the CPU 105 via a head driver 102A, on the basis of image data input from a host device 108 or the like. The CPU 105 drives a conveying motor 103C configured to drive the conveying part 103, via a motor driver 10313.

(Configuration of Print Head)

The print head 102 includes a printing element substrate 202 and a support member 201 supporting the same, and the printing, element substrate 202 has ejection ports 203, an ink flow path, and ejection energy generating elements. The print head 102 in the full-line printing apparatus 101 has a plurality of the printing element substrates 202 provided in a staggered manner, with a plurality of ejection ports 203 being arranged in a direction intersecting with (perpendicular to, in the case of the present embodiment) the conveying direction indicated by the arrow A. In the printing element substrate 202 of the present embodiment, the ejection ports 203 are arranged so as to form four ejection port columns, and the ejection port columns may respectively eject different ink or eject the same ink. The print head 102 of FIG. 1C has a plurality of the printing element substrates 202 provided thereon in a manner adjacent to each other. The print head 102 of FIG. 1D has a single printing element substrate 202 provided thereon. The configuration of the print head 102 is not limited to the examples of FIGS. 1B, 1C and 1D, and any of various configurations may be employed.

(Description of Configuration of Printing Element Substrate)

Figure 3A:
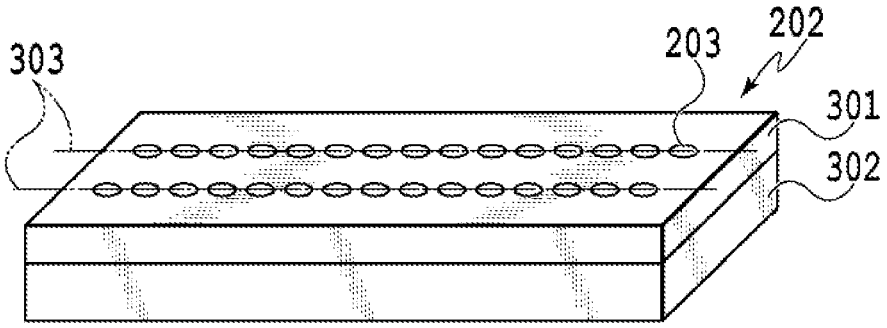
FIG. 3A is an explanatory diagram of an exemplary configuration of a printing element substrate in the print head.
Figure 3B:
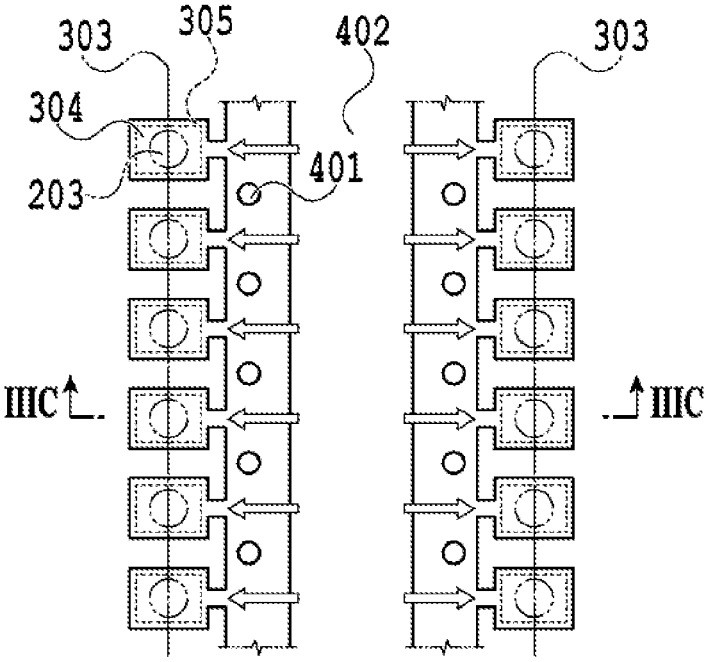
FIG. 3B is an explanatory diagram of an exemplary configuration of a printing element substrate in the print head.
Figure 3C:
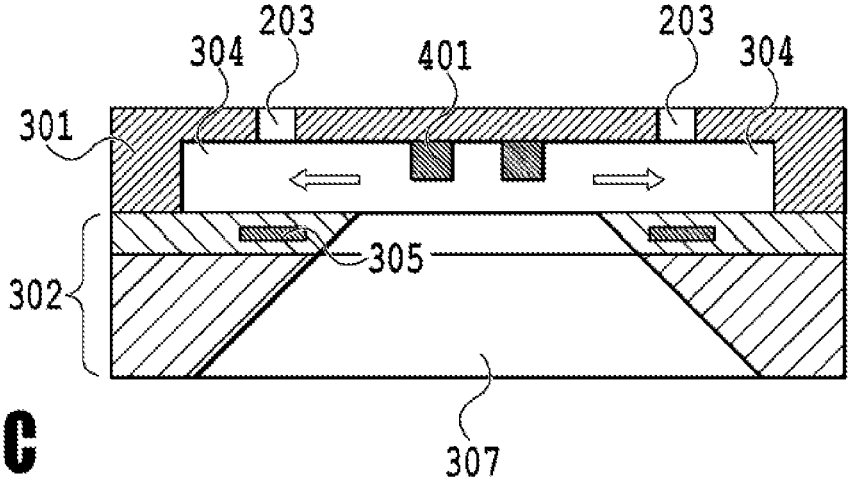
FIG. 3C is an explanatory diagram of an exemplary configuration of a printing element substrate in the print head.

FIGS. 3A to 3C are explanatory diagrams of an exemplary configuration of the printing element substrate 202 in the print head 102. FIG. 3A is a perspective view of the printing element substrate 202, with an orifice plate 301 joined on a substrate 302. The orifice plate 301 has a plurality of the ejection ports 203 provided thereon, the ejection ports 203 thereof forming an ejection port column 303. The front surface of the substrate 302 may have ejection energy generating elements, electric circuits, electric wiring, and electronic devices such as a temperature sensor provided thereon by semiconductor processing, and therefore a material such as a semiconductor substrate on which a flow path may be formed by MEMS processing is desirable as the material of the substrate 302. Any material may be employed as the material or the orifice plate 301. For example, a resin substrate on which ejection ports may be formed by laser processing, an inorganic plate on which ejection ports may be formed by dicing, a photosensitive resin material on which ejection ports and a flow path may be formed by light curing, and a semiconductor substrate on which ejection ports and a flow path may be formed by MEMS processing, or the like may be used.

FIG. 38 is an enlarged perspective view of the printing element substrate 202 seen from the orifice plate 301 side, and FIG. 3C is a cross-sectional view taken along line IIIC-IIIC of FIG. 3B. A pressure chamber 304 is formed in the space between the substrate 302 and the orifice plate 301, and an energy generating element 305 for causing ink to be ejected from the ejection port 203 is installed at a position of the substrate 302 facing the ejection port 203. An electro-thermal conversion element (heater) or a piezoelectric element may be used as the energy generating element 305. The pressure chamber 304, fluidly connected to a common liquid chamber 307, forms a continuous ink flow path (fluid flow path). The ejection port columns 303 are formed in parallel with the common liquid chamber 307 on both sides (right and left sides in FIGS. 3B and 3C) of the common liquid chamber 307 extending in the vertical direction in FIG. 3B, and the ink in the common liquid chamber 307 is ejected from the ejection ports 203 through the pressure chambers 304 on the both sides.

(Pressure Loss in Ink Supply System)

Figure 4:
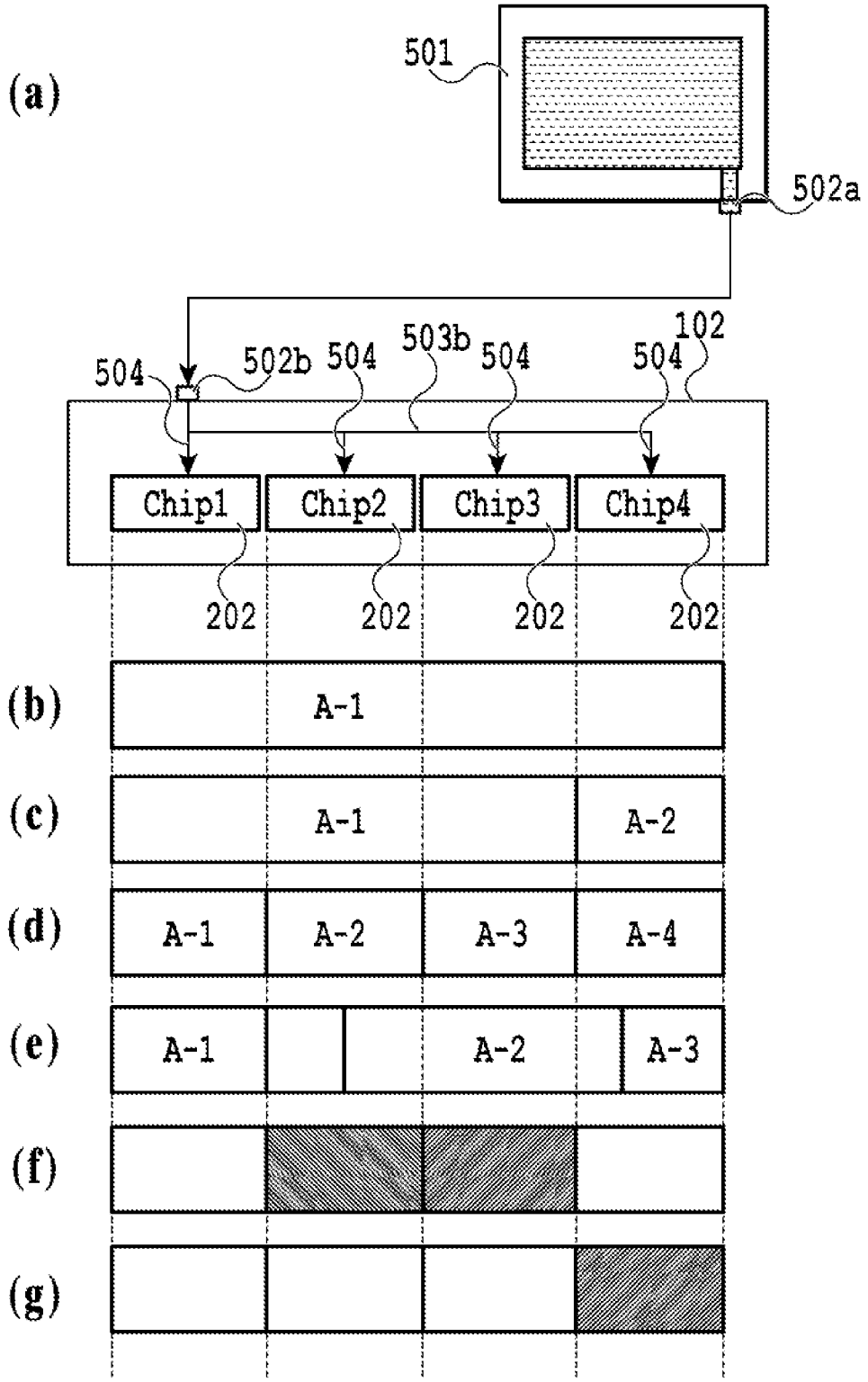
FIG. 4 illustrates an ink supply system of the printing apparatus, and a monitoring area corresponding to a printing element.

The part (a) of FIG. 4 illustrates the ink supply system of the printing apparatus 101 in the case where the printing element substrate has the configuration of FIG. 3, and the parts (b) to (g) illustrate monitoring areas corresponding to printing elements. A liquid connecting part 502*a* of the print head 102 is fluidly connected to a main tank 501 via a common flow path 503*a*, and ink existing in the main tank 501 is supplied to the print head 102. The ink supplied to the print head 102 is supplied from the common flow path 503*a*, via a plurality of supply flow paths 504 having branched from a common flow path 503*b* within the print head 102, to the printing element substrates 202 (Chip 1 to Chip 4) respectively corresponding to the supply flow paths 504.

On this occasion, the distance from a liquid connecting part 502*b* via the common flow path 503*b* becomes longer from the Chip 1 to the Chip 4, and therefore pressure loss that occurs along the way takes the following relation.

Chip 1<Chip 2<Chip 3<Chip 4

It is therefore necessary to control the flow amount in terms of printing element substrate in order to reduce the effect of ejection-induced pressure loss depending on the flow path length of the common flow path from the liquid connecting part 502*b*.

A print duty is expressed by a dot count, which is the number of ejected ink drops, and corresponds to the amount of ink applied per unit area. The dot count required for printing a filled image is assumed to be 100%.

In the present embodiment, monitoring areas are set to the printing element substrates 202 in accordance with the length of the distance from the liquid connecting part 502*b*, and there is set a threshold value Dt of dot count per unit time during which blur-free printing is possible for each of the monitoring areas. Accordingly, it turns out that the pressure loss exceeds a predetermined value in the case where the print duty in each monitoring area has exceeded the threshold value Dt. Since the pressure loss from the Chip 1 to the Chip 4 has the aforementioned relation, the print duty threshold value Dt decreases from the Chip 1 to the Chip 4. However, in the case where the pressure loss of the common flow path 503*b* is very small, it is possible to set the print duty threshold value Dt equally from the Chip 1 to the Chip 4.

Setting of a monitoring area for the ink flow amount will be described. Here, for convenience of explanation, there is proposed a configuration with four printing element substrates 202 (Chip 1 to the Chip 4) in the print head 102. The method of setting monitoring areas in the part (b) of FIG. 4 assumes the case where the entire print head 102 is used as a monitoring area A-1. In the part (c) of FIG. 4, the four printing element substrates 202 in the print head 102 are divided into a plurality of groups including different number of printing element substrates, i.e., three printing element substrates for the monitoring area A-1 and one printing element substrate for a monitoring area A-2. However, without being limited to the foregoing, monitoring areas may be set in manner including a same number of substrates. The part (d) of FIG. 4 illustrates the ease of setting monitoring areas in terms of printing element substrate (area setting process). The part (e) of FIG. 4 illustrates the case where the boundary of the monitoring areas exists within the printing element substrate. In the present embodiment, the case of the part (d) of FIG. 4 will be described below.

Here, for convenience of explanation, the print duty threshold value Dt in a monitoring area is given as follows. In comparison with a dot count for performing 100% printing, i.e., a print duty for printing a filled image, the dot count is set for performing 90% printing in the monitoring area A-1, 80% printing in the monitoring area A-2, 70% printing in the monitoring area A-3, and 60% printing in the monitoring area A-4. Print blur then occurs in the case where the average print duty in each monitoring area has exceeded each threshold value.

The part (f) of FIG. 4 illustrates monitoring areas in the case where the print duties in the monitoring areas A-2 and A-3 turn out to be print patterns expressing a dot count for performing 65% printing. In the case of setting a uniform threshold value in all the monitoring areas A-1, A-2, A-3 and A-4, it is necessary to set the threshold value to a dot count for performing 60% printing of the monitoring area A-4 in order to prevent occurrence of blur. In such a case, however, it is necessary to control the ink flow amount in order to perform printing with a print pattern such as that illustrated in part (f) of FIG. 4. In other words, the threshold value Dt corresponds to a dot count for performing 60% printing, in comparison with the dot count for performing 65% printing according to the print duty in the monitoring areas A-2 and A-3, and therefore it is necessary to control the ink flow amount. It turns out to be an excessive control over monitoring areas in which the print duties potentially allow for 80% and 70% printing, respectively.

In addition, the part (g) of FIG. 4 illustrates monitoring areas in the case where the print duty in the monitoring area A-4 turns out to be a print pattern expressing a dot count for performing 65% printing. In such a case, providing a single monitoring area over the entire head such as for example the part (b) of FIG. 4 results in the average print duty in the monitoring area being 16.3%, whereby no control is applied. However, observing only the monitoring area A-4 such as for example the part (g) of FIG. 4, the threshold value of the print duty is 60% and therefore it is necessary to control the flow amount, whereby blur may occur at the time of printing.

Therefore, in the present embodiment, considering the aforementioned situation, the pressure loss and the print duty threshold value Dt are set for each monitoring area, and the ink flow amount is controlled on the basis thereof. In the example of FIG. 4(*f*), the print duty allows for 80% and 70% printing, respectively, in the monitoring areas A-2 and A-3. Therefore, it is possible to perform printing without applying control to a dot count for performing 65% printing according to the print duties in the monitoring areas A-2 and A-3. Additionally, in the case of the part (g) of FIG. 4, the dot count is set for performing 60% printing according to the print duty in the monitoring area A-4, and therefore the flow amount is controlled for the dot count for performing 65% printing according to the print duty in the monitoring area A-4.

Here, a calculation method of pressure loss ΔP will be described. As illustrated in the part (a) of FIG. 4, the monitoring areas A-1, A-2, A-3 and A-4 are set, and the pressure loss ΔP is calculated for each of the areas. Generally, the pressure loss ΔP is expressed by formula (1), where R denotes the flow resistance and Q denotes the flow amount.

$$\Delta P = R \times Q \qquad \text{formula (1)}$$

The flow resistance R is expressed by formula (2), where η denotes the ink viscosity, Li denotes the flow path length of the common flow path 503*b* from the liquid connecting part 502*b* to each printing element substrate Chip, and φ denotes the diameter of the pipe line.

$$R = 128\eta\ Li/(\pi\varphi 4) \qquad \text{formula (2)}$$

In addition, the flow amount Q is expressed by formula (3), where n denotes the number of the ejecting nozzles, Vd denotes the ejection amount, and fop denotes the ejection frequency.

$$Q = n \times Vd \times fop \qquad \text{formula (3)}$$

In the present embodiment, the pressure loss ΔP is calculated for each of the monitoring areas A-1, A-2, A-3 and A-4.

First, the calculation method of the pressure loss ΔP1 in the monitoring area A-1 will be described. The pressure loss ΔP1 is expressed by formula (4), where R0 and Q0 respectively denote the flow resistance and the flow amount between the main tank 501 and the print head 102 connected at the liquid connecting parts 502*a* and 502*b*, and R1 and Q1 respectively denote the flow resistance and the flow amount from the liquid connecting part 502*b* to the Chip 1.

$$\Delta P1 = R0 \times Q0 + R1 \times Q1 \qquad \text{formula (4)}$$

Similarly, the pressure losses ΔP2, ΔP3 and ΔP4 in the monitoring areas A-2, A-3 and A-4 are expressed by formulae (5), (6) and (7).

$$\Delta P2=R0\times Q0+R2\times Q2 \quad \text{formula (5)}$$

$$\Delta P3=R0\times Q0+R3\times Q3 \quad \text{formula (6)}$$

$$\Delta P4=R0\times Q0+R4\times Q4 \quad \text{formula (7)}$$

Furthermore, relation of flow amounts is given by the following formula (8).

$$Q0=Q1+Q2\pm Q3+Q4 \quad \text{formula (8)}$$

Note that, in each monitoring area, a tolerable pressure loss is determined by a print duty (converted into number of dots during the control process) that allows for blur-free printing. Therefore, the aforementioned formulae (4) to (7) are applied to calculate the threshold values ΔPt1, ΔPt2, ΔPt3 and ΔPt4 of the pressure loss in respective monitoring areas.

Here, the print duty threshold value Dt, corresponding to the number of ejecting nozzles of the aforementioned formula (3), may be calculated from the flow amount Q, the ejection amount Vd, and the ejection frequency fop.

Note that the print duty threshold value Dt varies in accordance with the environmental temperature or the print head temperature. This is because temperature variation brings about change of ink viscosity, whereby the pressure loss may change.

(Control of Ink Flow Amount)

Figure 5:
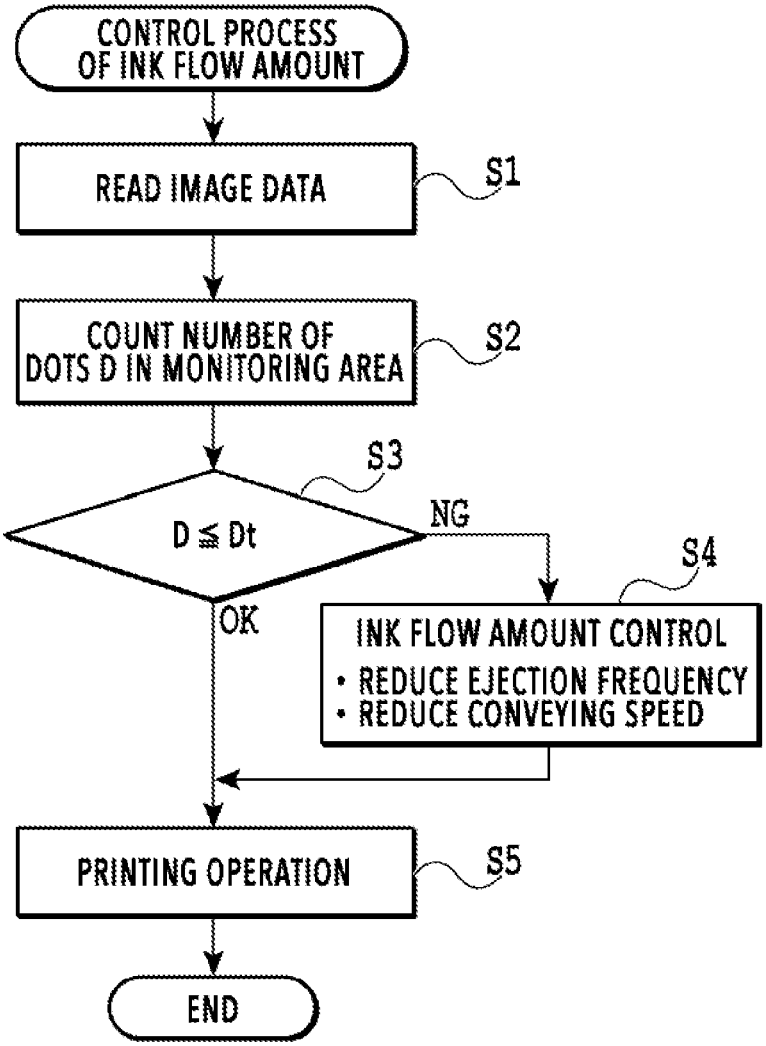
FIG. 5 is a flowchart illustrating a control process of the ink flow amount.

FIG. 5 is a flowchart illustrating a control process of the ink flow amount in the present embodiment. In the following, a control process of the ink flow amount of the present embodiment will be described using the flowchart. Upon starting the control process of the ink flow amount, the CPU 105 reads image data from the host device 108 and the like at S1. Subsequently, at S2, the number of dots D in a monitoring area preliminarily specified in the print head is counted. Then, it is determined (compared), at S3, whether the counted number of dots D is equal to or smaller than the threshold value Dt (equal to or smaller than the threshold value). In the case where the number of dots D is equal to or smaller than the threshold value Dt, the process flow proceeds to S5 at which a printing operation is performed and the process is terminated. In the case where the number of dots D is not equal to or smaller than the threshold value Dt, the process flow proceeds to S4 at which the ink ejection frequency is reduced and the conveying speed of the print medium 104 is reduced in a manner corresponding thereto, whereby the amount of ink flow passing through the monitoring area is reduced. Subsequently, the process flow proceeds to S5 at which a printing operation is performed and the process is terminated.

In the present embodiment, as thus described, the threshold value Dt that allows for printing without occurrence of blur is preliminarily set for each of the preliminarily set monitoring areas (threshold value setting). Then, in the case where the print duty for each monitoring area has exceeded the threshold value Dt, the ink ejection frequency and the conveying speed of the print medium may be reduced in a related manner so as to suppress local pressure loss in the print head. In other words, reducing the amount of ink ejection from the print head per unit time allows for reliably supplying ink to the printing element substrate. Accordingly, an image forming apparatus capable of performing printing with a high image quality, and a control method of the image forming apparatus have been realized.

Note that the amount of ink ejection per unit time may be controlled by changing the size of ink drops, as well as changing the ejection frequency corresponding to the number of ink ejections per unit time. In other words, it suffices that the amount of ejection per unit time of ink may be controlled so that the ink flow amount for each monitoring area turns out to be equal to or smaller than a predetermined amount.

Second Embodiment

In the following, a second embodiment of the present invention will be described, referring to the drawings. Since the basic configuration of the present embodiment is similar to that of the first embodiment, only characteristic components will be described below. In the present embodiment, there will be described a case where a circulation flow flows in the printing element substrate.

(Description of Inkjet Printing Apparatus)

Figure 6:
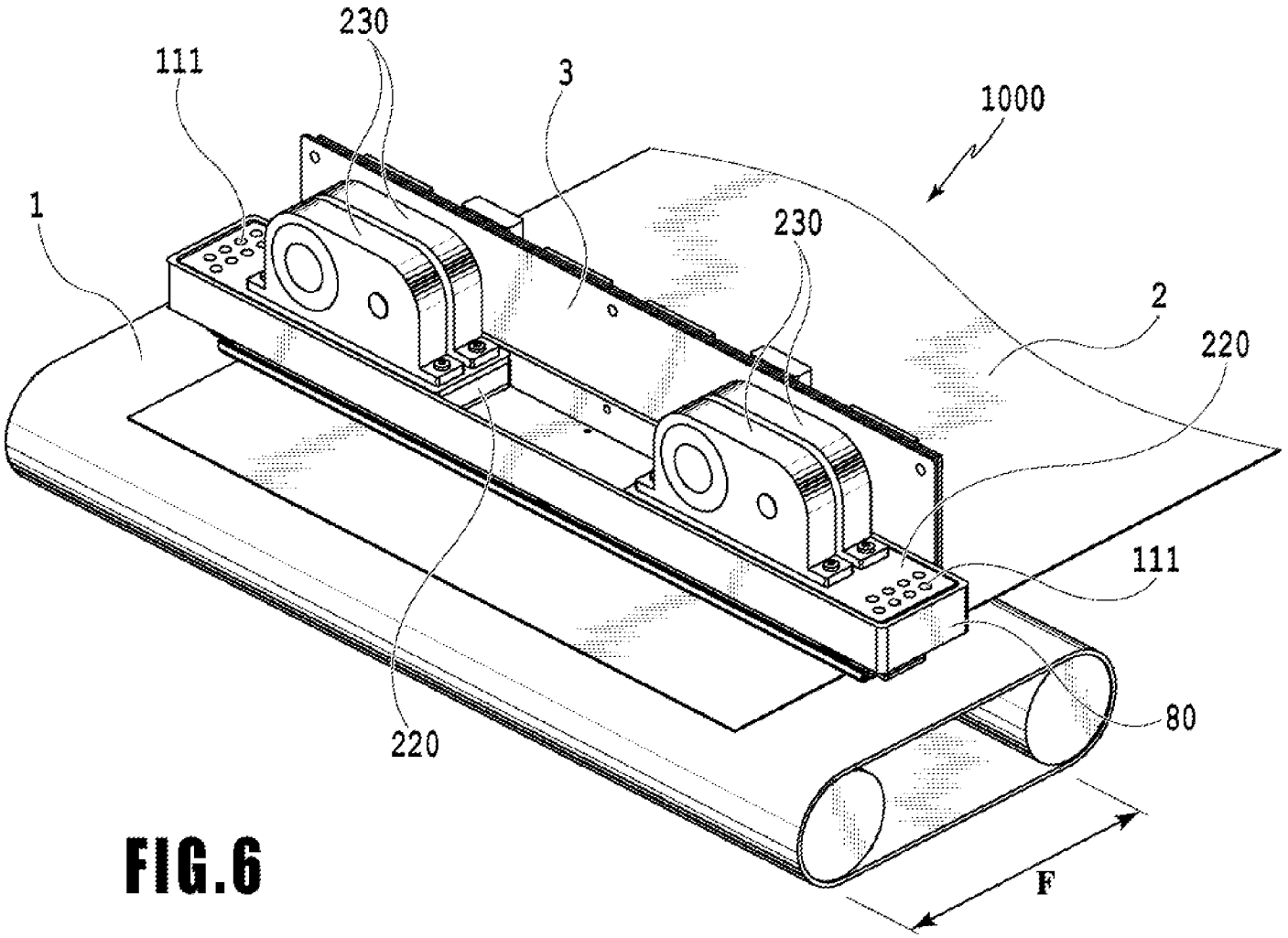
FIG. 6 illustrates an overall configuration of the printing apparatus.

FIG. 6 illustrates an overall configuration of a liquid ejection apparatus of the present embodiment configured to eject liquid, particularly an inkjet printing apparatus (also referred to as printing apparatus in the following) 1000 configured to eject ink and perform printing. The printing apparatus 1000, including a conveying part 1 configured to convey a print medium 2, and a line-type liquid ejection head 3 provided generally perpendicular to the conveying direction of the print medium 2, is a line-type printing apparatus configured to perform continuous printing in a single pass, while conveying a plurality of sheets of the print medium 2 continuously or intermittently. The liquid ejection head 3 has negative pressure control units 230 configured to control pressure (negative pressure) in the circulation path, liquid supply units 220 in fluid communication with the negative pressure control units 230, liquid connecting parts 111 that serve as supply and outlet ports of ink to the liquid supply units 220, and a housing 80. The print medium 2 is not limited to cut sheets and may be a continuous roll medium. The liquid ejection head 3 is capable of full color printing using ink of colors Cyan C, magenta M, yellow Y, and black K, and has fluidly connected thereto a liquid supply unit, which is a supply path for supplying liquid to the liquid ejection head 3, a main tank, and a buffer tank (see FIG. 7A, FIG. 7B described below). The printing apparatus 1000 is an inkjet printing apparatus in the form of circulating liquid such as ink between a tank described below and the liquid ejection head 3.

(Description of Circulation Mechanism)

Figure 7A:
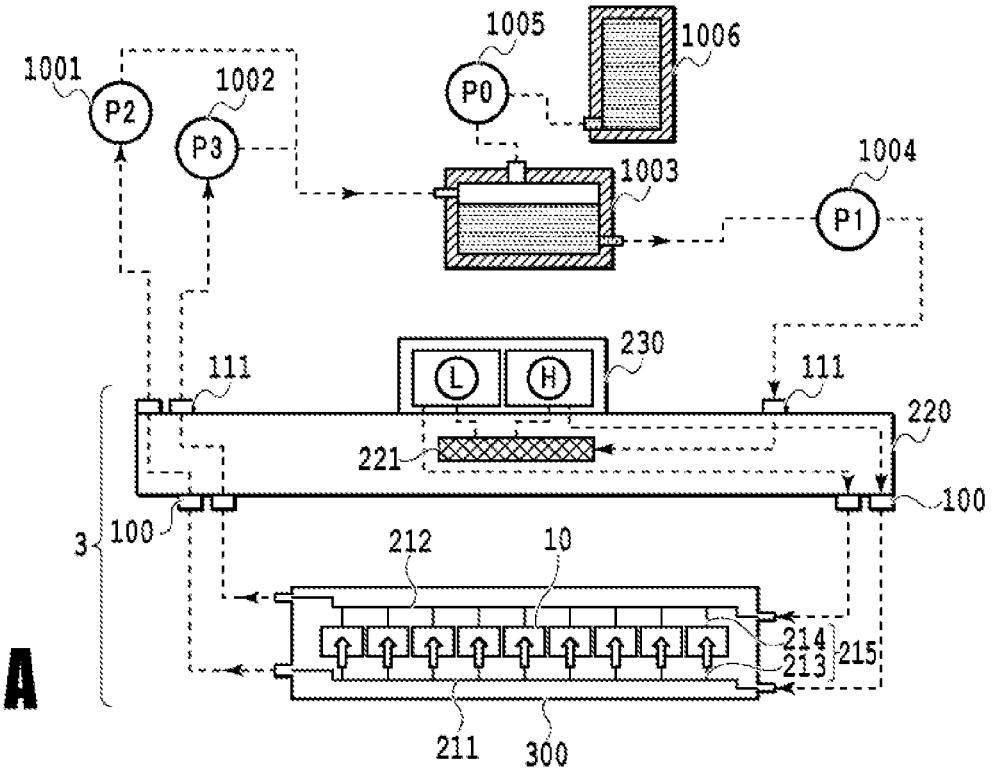
FIG. 7A is a schematic diagram illustrating a first circulation mechanism of a circulation path.
Figure 7B:
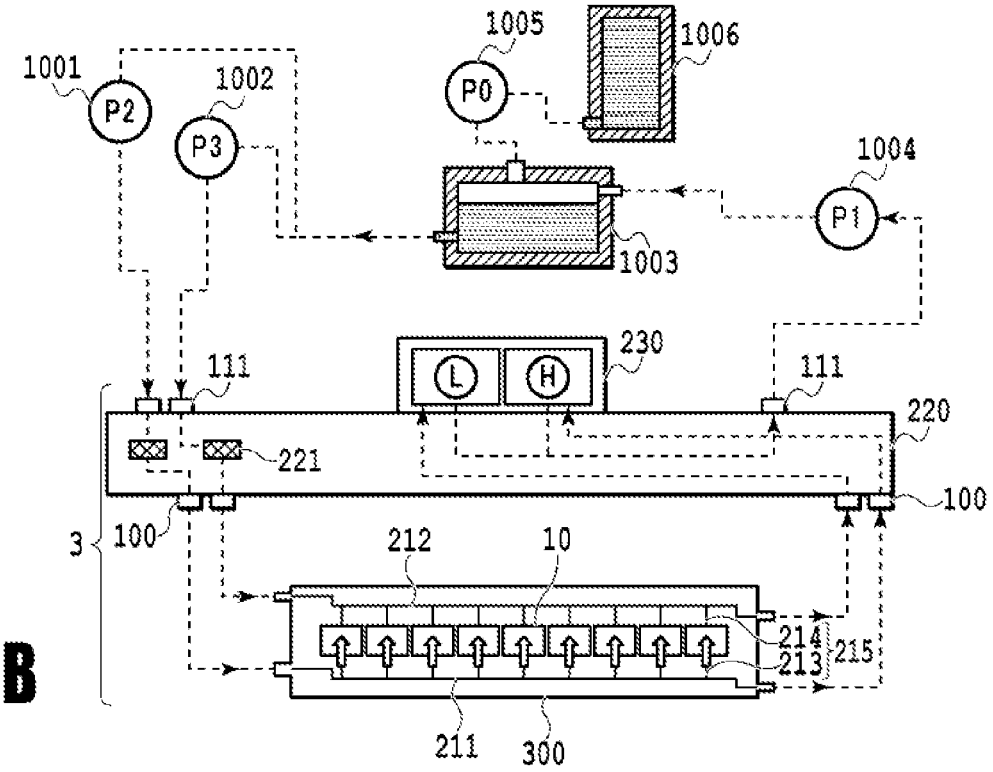
FIG. 7B is a schematic diagram illustrating a second circulation mechanism of the circulation path.

FIG. 7A is a schematic diagram illustrating a first circulation mechanism of the circulation path applied to the printing apparatus 1000 of the present embodiment, and FIG. 7B is a schematic diagram illustrating a second circulation mechanism. The liquid ejection head 3 is fluidly connected to a first circulation pump (at the high pressure side) 1001, a first circulation pump (at the low pressure side) 1002, and a buffer tank 1003. Note that although FIG. 7A, FIG. 7B illustrates only one path through which one of the ink colors cyan C, magenta M, yellow Y, and black K flows, for simplicity of description, circulation paths corresponding to the four colors are actually provided in the liquid ejection head 3 and the printing apparatus main body.

In the first circulation mechanism, ink in the main tank 1006 is supplied to the buffer tank 1003 by a refilling pump 1005, and subsequently supplied to the liquid supply unit 220 of the liquid ejection head 3 via the liquid connecting part 111 by a second circulation pump 1004. Subsequently, the ink, which has been regulated to two different negative pressures (high pressure and low pressure) at the negative pressure control unit 230 connected to the liquid supply unit 220, circulates in a manner divided into two flow paths at the high pressure side and the low pressure side. The ink in the liquid ejection head 3 circulates through a liquid ejection head by operation of the first circulation pump (at the high pressure side) 1001 and the first circulation pump (at the low pressure side) 1002, is discharged from the liquid ejection head 3 via the liquid connecting part 111, and returns to the buffer tank 1003.

The buffer tank 1003, which is a sub-tank connected to the main tank 1006, has an atmosphere communication port (not illustrated) that causes the interior of the tank to communicate with the outside, and is capable of discharging air bubbles in the ink to the outside. The refilling pump 1005 is provided between the buffer tank 1003 and the main tank 1006. The refilling pump 1005 transfers ink from the main tank 1006 to the buffer tank 1003, as much as that consumed by ejecting (discharging) the ink from the ejection ports of the liquid ejection head 3, such as printing or suction recovery accompanying ejection of ink.

The two first circulating pumps 1001 and 1002 draw liquid from the liquid connecting part 111 of the liquid ejection head 3, and cause the liquid to flow toward the buffer tank 1003. A positive displacement pump having a quantitative liquid feeding capacity is preferred as the first circulation pump. Although a tube pump, a gear pump, a diaphragm pump, a syringe pump or the like may be specifically mentioned, it suffices to secure a constant flow amount by providing a common constant flow valve or a relief valve at the pump outlet, for example. In the case where the liquid ejection head 3 is being driven, activation of the first circulation pump (at the high pressure side) 1001 and the first circulation pump (at the low pressure side) 1002 causes ink of a predetermined flow amount to flow through the common supply flow path 211 and a common collection flow path 212, respectively.

Causing the ink to flow as thus described maintains the temperature of the liquid ejection head 3 at the time of a printing at an optimal temperature. The predetermined flow amount in the case where the liquid ejection head 3 is driven is preferred to be set equal to or more than a flow amount that allows the temperature difference between respective printing element substrates 10 of the liquid ejection head 3 to be maintained at a degree that does not affect the print image quality. However, setting an excessively large flow amount may cause the negative pressure difference between respective printing element substrates 10 to grow larger due to the effect of pressure loss of the flow path in the liquid ejection unit 300, which may result in density non-uniformity in the image. Therefore, it is preferred to set the flow amount while taking into account temperature difference and negative pressure difference between respective printing element substrates 10.

The negative pressure control unit 230 is provided in a path between the second circulation pump 1004 and the liquid ejection unit 300. The negative pressure control unit 230 operates to maintain the pressure at the downstream (i.e., the liquid ejection unit 300 side) of the negative pressure control unit 230 to a preliminarily set constant pressure, even in the case where the ink flow amount in the circulation system varies due to difference and the like of ejection amount per unit area. Any mechanism may be used as two pressure regulating mechanisms included in the negative pressure control unit 230, provided that they are capable of controlling variation of pressure at the downstream of the negative pressure control unit 230 to stay within a certain range centered at a desired pressure setting.

As an example, a mechanism similar to the so-called "vacuum regulator" may be employed. In the circulation path of the present embodiment, the second circulation pump 1004 pressurizes the upstream of the negative pressure control unit 230 via the liquid supply unit 220. Since the effect of the hydraulic head pressure on the liquid ejection head 3 of the buffer tank 1003 may be suppressed in the aforementioned manner, it is possible to increase the degree of freedom of the layout of the buffer tank 1003 in the printing apparatus 1000.

Any pump may be used as the second circulation pump 1004, provided that it exhibits a pump head pressure equal to or higher than a certain pressure within a range of ink circulation flow amount used in the case where the liquid ejection head 3 is being driven, and therefore a turbo pump or a positive displacement pump may be employed. Specifically, a diaphragm pump or the like is applicable. Additionally, in place of the second circulation pump 1004, a water head tank provided with a certain water head difference relative to the negative pressure control unit 230 is applicable, for example. The negative pressure control unit 230 has, as illustrated in FIG. 7A, FIG. 7B, two pressure regulating mechanisms having mutually different control pressures set thereto. Of the two negative pressure regulating mechanisms, the relatively high pressure setting side (denoted H in FIG. 7A, FIG. 7B) and the relatively low pressure side (denoted L in FIG. 7A, FIG. 7B) are respectively connected to the common supply flow path 211 and the common collection flow path 212 in the liquid ejection unit 300 via the liquid supply unit 220.

The liquid ejection unit 300 has provided therein the common supply flow path 211, the common collection flow path 212, and individual flow paths 215 (individual supply flow path 213 and individual collection flow path 214) in communication with respective printing element substrates. The common supply flow path 211 has a pressure regulating mechanism H connected thereto, and the common collection flow path 212 has a pressure regulating mechanism L connected thereto, with a difference pressure occurring between the two common flow paths. The individual supply flow path 213 and the individual collection flow path 214 are in communication with the common supply flow path 211 and the common collection flow path 212, and therefore a part of the liquid flows from the common supply flow path 211, passing through an internal flow path of the printing element substrate 10, to the common collection flow path 212 (indicated by arrows in FIGS. 7A and 7B).

As thus described, a flow occurs in the liquid ejection unit 300 so that a part of the liquid passes through each of the printing element substrates 10, while causing the liquid to flow through the common supply flow path 211 and the common collection flow path 212, respectively. Accordingly, it is possible to release the heat that occurs in each of the printing element substrates 10 to the outside of the printing element substrates 10 by the ink flowing through the common supply flow path 211 and the common collection flow path 212. In addition, such a configuration allows for generating a flow of ink also in an ejection port or a pressure chamber that are not performing ejection, in the case where printing is performed by the liquid ejection head 3. Accordingly, it is possible to suppress increase of viscosity of ink by decreasing the viscosity of ink which has increased in the ejection port. In addition, it is possible to discharge ink with increased viscosity or foreign matters in the ink to the common collection flow path 212. Accordingly, the liquid ejection head 3 of the present embodiment turns out to be capable of high-speed and high-resolution printing.

(Description of Liquid Ejection Head Configuration)

Figure 8:
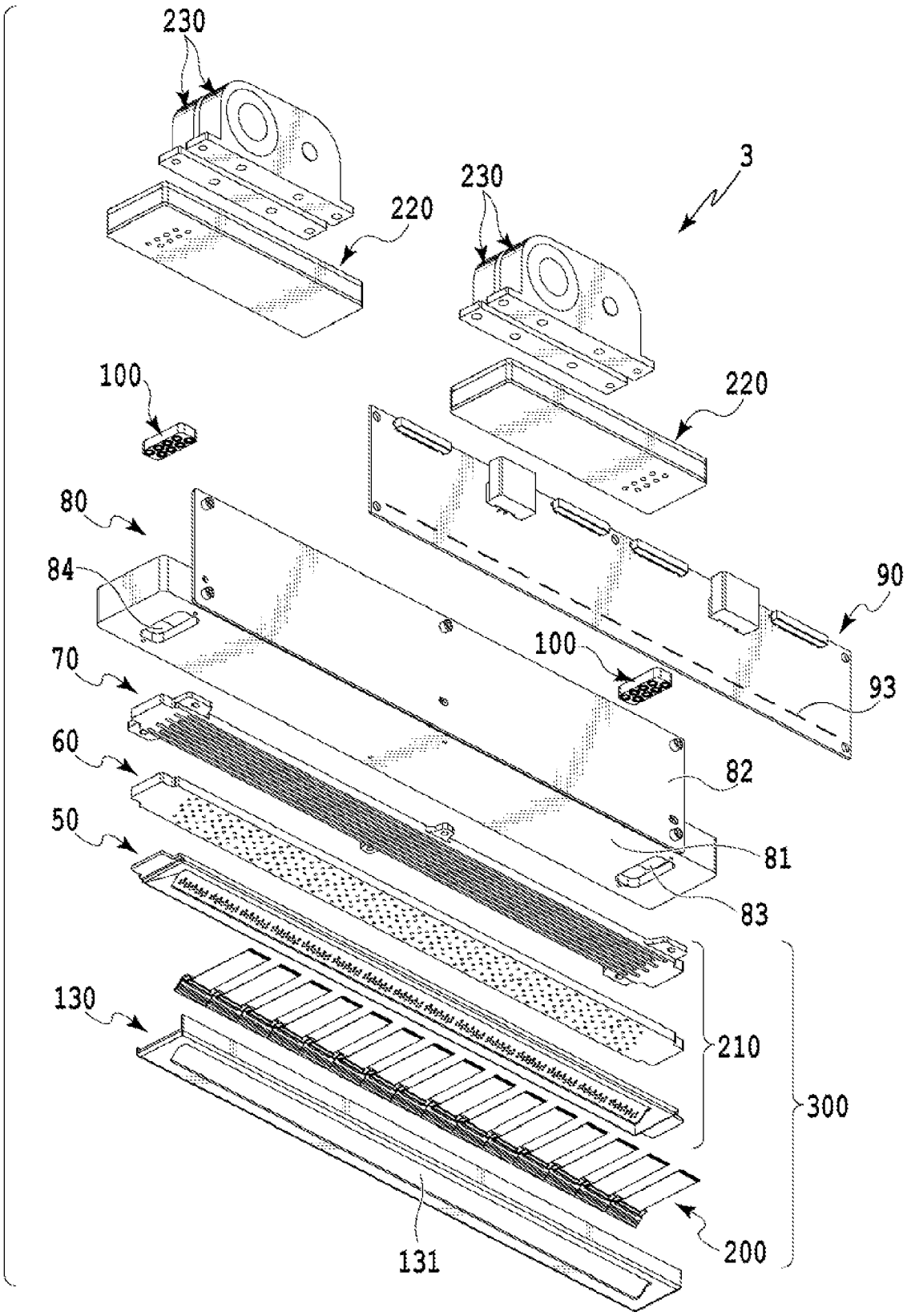
FIG. 8 is an exploded perspective view illustrating respective parts or units included in a liquid ejection head.

FIG. 8 is an exploded perspective view illustrating each of components or units included in the liquid ejection head 3. The liquid ejection unit 300, the liquid supply units 220, and an electric wiring substrate 90 are attached to the housing 80. The liquid supply units 220 have the liquid connecting parts 111 (see FIG. 7A) provided therein, with a filter 221 (see FIG. 7A) for each color in communication with each aperture of the liquid connecting parts 111 provided inside the liquid supply units 220 to remove foreign matters in the ink to be supplied. Each of the two liquid supply units 220 has the filter 221 for two colors. In the first circulation mechanism illustrated in FIG. 7A, the liquid having passed through the filter 221 is supplied to the negative pressure control unit 230 provided on the liquid supply unit 220 in association with each color.

The negative pressure control unit 230, which is a unit including a pressure regulation valve for each color, significantly attenuates pressure loss variation in the supply system of the printing apparatus 1000 (supply system located upstream of the liquid ejection head 3) that occurs together with variation of the liquid flow amount due to operation of the valve or a spring member provided in each pressure regulation valve. Accordingly, the negative pressure control unit 230 is capable of stabilizing the negative pressure variation at the downstream (at the liquid ejection unit 300 side) of the negative pressure control unit within a certain range. As has been described with regard to FIG. 7A, the negative pressure control unit 230 for each color has two pressure regulation valves built therein for each color. The two pressure regulation valves are respectively set to different control pressures, with the high pressure side in communication with the common supply flow path 211 (see FIG. 7A) in the liquid ejection unit 300, and the low pressure side in communication with the common collection flow path 212 (see FIG. 7A) via the liquid supply unit 220.

The housing 80, including a liquid ejection unit support member 81 and an electric wiring substrate support member 82, supports the liquid ejection unit 300 and the electric wiring substrate 90, and secures the rigidity of the liquid ejection head 3. The electric wiring substrate support member 82, which is intended to support the electric wiring substrate 90, is fixed to the liquid ejection unit support member 81 by screw-fastening. The liquid ejection unit support member 81 has a role of correcting warping or deformation of the liquid ejection unit 300, and securing the relative position precision of a plurality of the printing element substrates 10, thereby suppressing streaks or unevenness in printed materials. Therefore, the liquid ejection unit support member 81 is preferred to have sufficient rigidity, for which a metal material such as SUS or aluminum, or ceramic such as alumina is suitable as the material. The liquid ejection unit support member 81 has provided thereon apertures 83 and 84 to which joint rubber 100 is to be inserted. The liquid supplied from the liquid supply unit 220 is led to the third flow path member 70 included in the liquid ejection unit 300 via the joint rubber.

The liquid ejection unit 300 includes a plurality of ejection modules 200 and a flow path member 210, and a cover member 130 is attached to a surface at the print medium side of the liquid ejection unit 300. Here, the cover member 130 is a member having a picture-frame like front surface having an elongated aperture 131 provided thereon as illustrated in FIG. 8, with the printing element substrate 10 and a sealing member 110 included in each of the ejection modules 200 being exposed from the aperture 131 (see FIG. 12A described below). A frame part around the aperture 131 has a functions as an abutting surface of a cap member for capping the liquid ejection head 3 in a print wait state. Therefore it is preferred to form a closed space at the time of capping by coating an adhesive, a sealing member, a filling material or the like along the circumference of the aperture 131, and filling the unevenness or gaps on the ejection port surface of the liquid ejection unit 300.

Next, a configuration of the flow path member 210 included in the liquid ejection unit 300 will be described. The flow path member 210, which is a lamination of a first flow path member 50, a second flow path member 60, and a third flow path member 70, as illustrated in FIG. 8, distributes the liquid supplied from the liquid supply unit 220 to each of the ejection modules 200. In addition, the flow path member 210 is a flow path member for returning the liquid circulating back from the ejection modules 200 to the liquid supply unit 220. The flow path member 210 is fixed to the liquid ejection unit support member 81 by screw-fastening, thereby suppressing warping or deformation of the flow path member 210.

Figure 9:
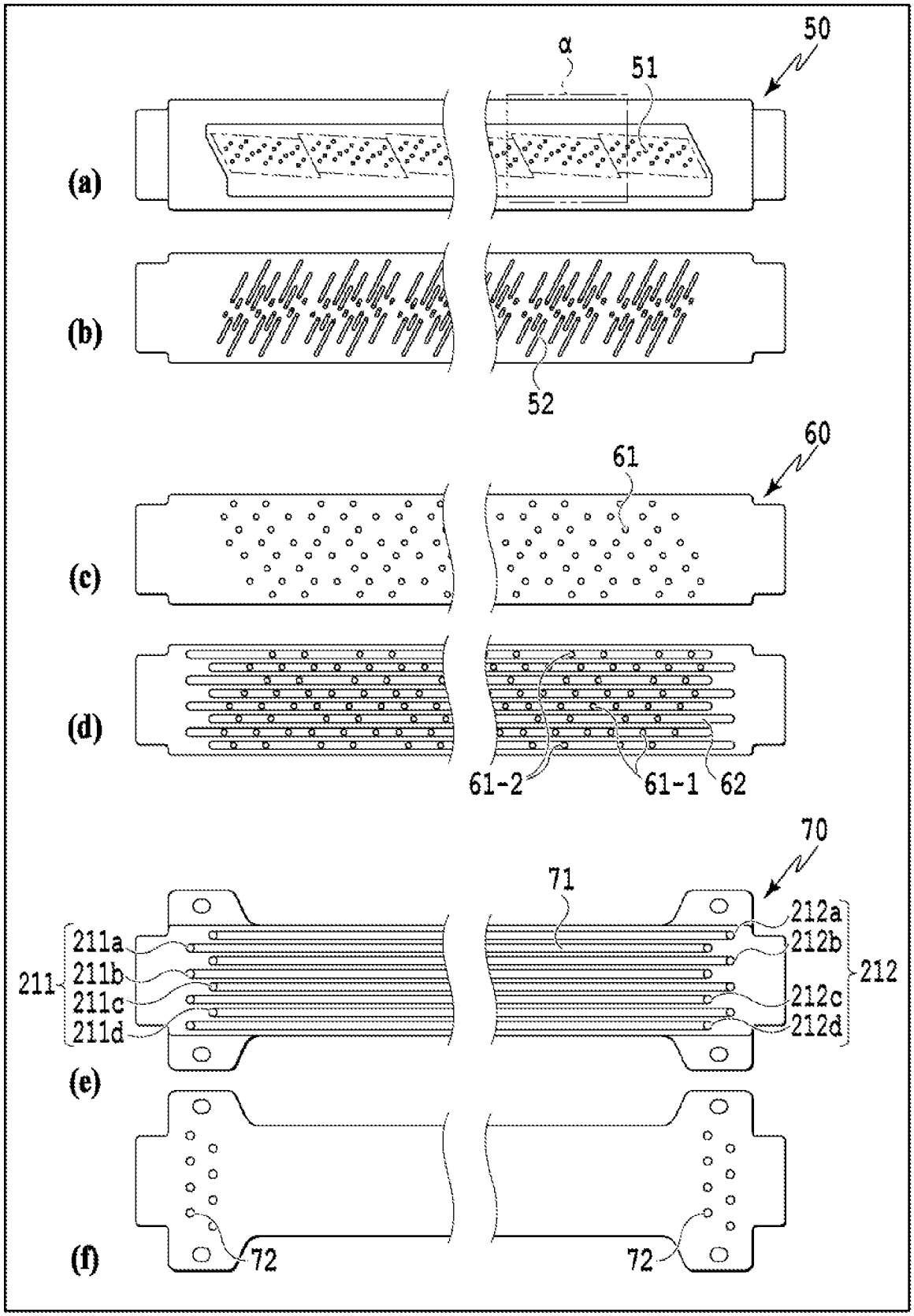
FIG. 9 illustrates front surfaces and back surfaces, respectively of a first to a third flow path members.

FIG. 9 illustrates front surfaces and back surfaces, respectively of the first to the third flow path members. The part (a) of FIG. 9 illustrates a surface of the first flow path member 50 on which the ejection modules 200 are mounted, and the part (f) illustrates a surface of the third flow path member 70 abutting the liquid ejection unit support member 81. The first flow path member 50 and the second flow path member 60 are joined so that the part (b) and the part (c), which are the abutting surfaces of respective flow path members, face each other, and the second flow path member and the third flow path member are joined so that the part (d) and the part (e), which are the abutting surfaces of respective flow path members, face each other. Joining the second flow path member 60 and the third flow path member 70 forms, from the common flow path grooves 62 and 71 formed on each flow path member, eight common flow paths (211*a*, 211*b*, 211*c*, 211*d*, 212*a*, 212*b*, 212*c* and 212*d*) extending in the longitudinal direction of the flow path member. Accordingly, a set of the common supply flow path 211 and the common collection flow path 212 for each color is formed in the flow path member 210.

Ink is supplied from the common supply flow path 211 to the liquid ejection head 3, and the ink supplied to the liquid ejection head 3 is collected by the common collection flow path 212. A communication port 72 (see part (f) of FIG. 9) of the third flow path member 70 is in communication with respective holes of the joint rubber 100 and is in fluid communication with the liquid supply unit 220 (see FIG. 8). The bottom of a common flow path groove 62 of the second flow path member 60 has a plurality of communication ports 61 (communication ports 61-1 in communication with the common supply flow path 211, and communication ports 61-2 in communication with the common collection flow path 212) formed thereon, which are in communication with one end of an individual flow path groove 52 of the first flow path member 50. The other end of the individual flow path groove 52 of the first flow path member 50 has a communication port 51 formed thereon, which are in fluid communication with the plurality of ejection modules 200 via the communication port 51. The individual flow path groove 52 allows for joining the flow paths toward the center of the flow path member.

The first to the third flow path members are preferred to have corrosion resistance against liquid and be made of a material with a low linear expansion coefficient. For example, a composite material (resin material) may be suitably used as the material, having added inorganic fillers such as silica particulates or fibers to a base material of alumina, LCP (liquid crystal polymer), PPS (polyphenyl sulfide), or PSF (polysulphone). The formation method of the flow path member 210 may use laminating three flow path member to adhere with each other, or, in the case where a composite material (resin material) is selected as the material, a joining method by welding may be used.

Figure 10:
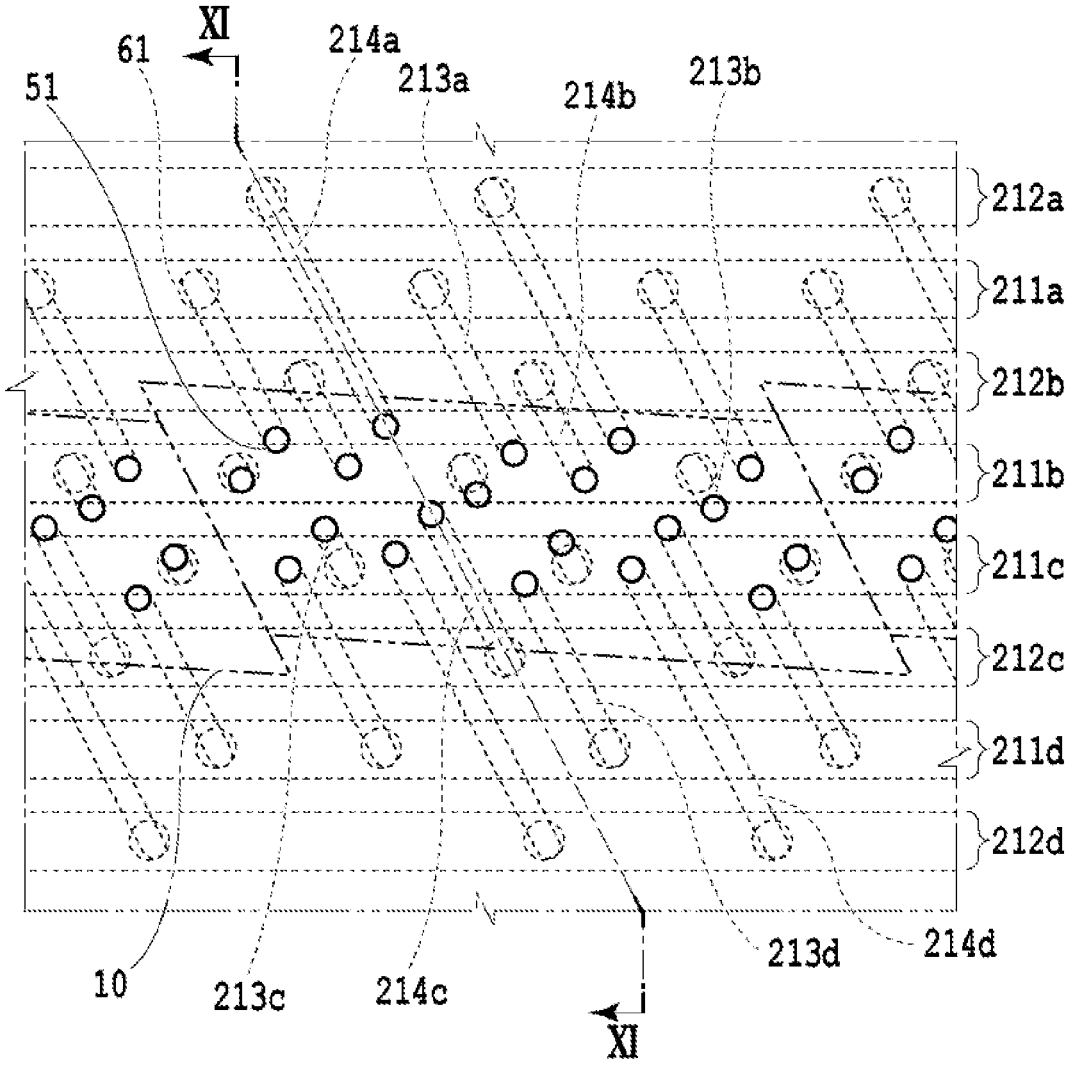
FIG. 10 illustrates a part a of the part (a) of FIG. 9.

FIG. 10, illustrating the part "α" of the part (a) of FIG. 9, is a perspective view illustrating, in an enlarged manner, a part of the flow path in the flow path member 210 formed by joining the first to the third flow path members, from the side of the surface of the first flow path member 50 on which the ejection module 200 is mounted. The common supply flow paths 211 and the common collection flow paths 212 are provided alternately from flow paths at both ends. Here, the connection relation between respective flow paths in the flow path member 210 will be described.

The flow path member 210 has provided therein the common supply flow paths 211 (211*a*, 211*b*, 211*c* and 211*d*) and the common collection flow paths 212 (212*a*, 212*b*, 212*c* and 212*d*), which are extending in the longitudinal direction of the liquid ejection head 3 for each color. The common supply flow paths 211 for each color have connected thereto, via the communication ports 61, a plurality of individual supply flow paths (213*a*, 213*b*, 213*c* and 213*d*) formed by the individual flow path groove 52. In addition, the common collection flow paths 212 for each color have connected thereto, via the communication ports 61, a plurality of individual collection flow paths (214*a*, 214*b*, 214*c* and 214*d*) formed by the individual flow path groove 52. Such a flow path configuration allows for collecting ink from each of the common supply flow paths 211 to the printing element substrate 10 located at the central part of the flow path member, via the individual supply flow path 213. In addition, it is possible to collect ink from the printing element substrate 10 to each the common collection flow paths 212 via the individual collection flow path 214.

Figure 11:
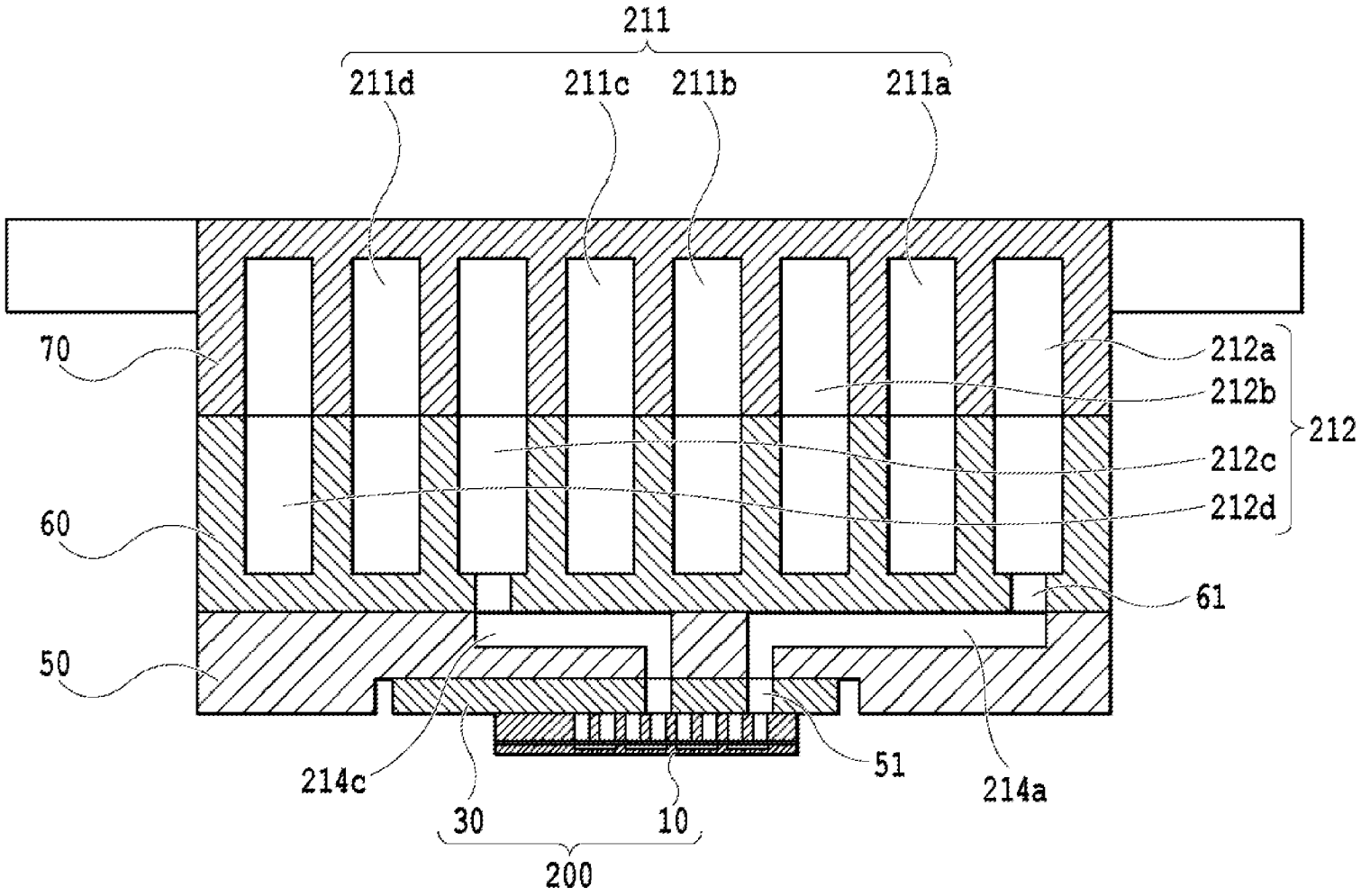
FIG. 11 illustrates a cross-section taken along XI-XI of FIG. 10.

FIG. 11 illustrates a cross-section taken along XI-XI of FIG. 10. Each of the individual collection flow paths (214*a* and 214*c*) is in communication with the ejection module 200 via the communication port 51. Although only the individual collection flow paths (214*a* and 214*c*) are illustrated in FIG. 11, the individual supply flow path 213 and the ejection module 200 are in communication in another cross-section, as illustrated in FIG. 10. A support member 30 and the printing element substrate 10 included in each of the ejection modules 200 have a flow path formed therein for supplying ink from the first flow path member 50 to a printing element 15 provided on the printing element substrate 10. Furthermore, the support member 30 and the printing element substrate 10 have formed therein a flow path for collecting (circulating), into the first flow path member 50, a part or all of the liquid supplied to the printing element 15.

Here, the common supply flow path 211 for each color is connected to the negative pressure control unit 230 (at the high pressure side) of a corresponding color via the liquid supply unit 220, and the common collection flow path 212 is connected to the negative pressure control unit 230 (at the low pressure side) via the liquid supply unit 220. The negative pressure control unit 230 is intended to generate a difference pressure (difference of pressure) between the common supply flow path 211 and the common collection flow path 212. Accordingly, as illustrated in FIGS. 10 and 11, a flow occurs in the order of the common supply flow path 211, the individual supply flow path 213, the printing element substrate 10, the individual collection flow path 214, and the common collection flow path 212 for each ink color in the liquid ejection head of the present embodiment that connects respective flow paths.

(Description of Ejection Module)

Figure 12A:
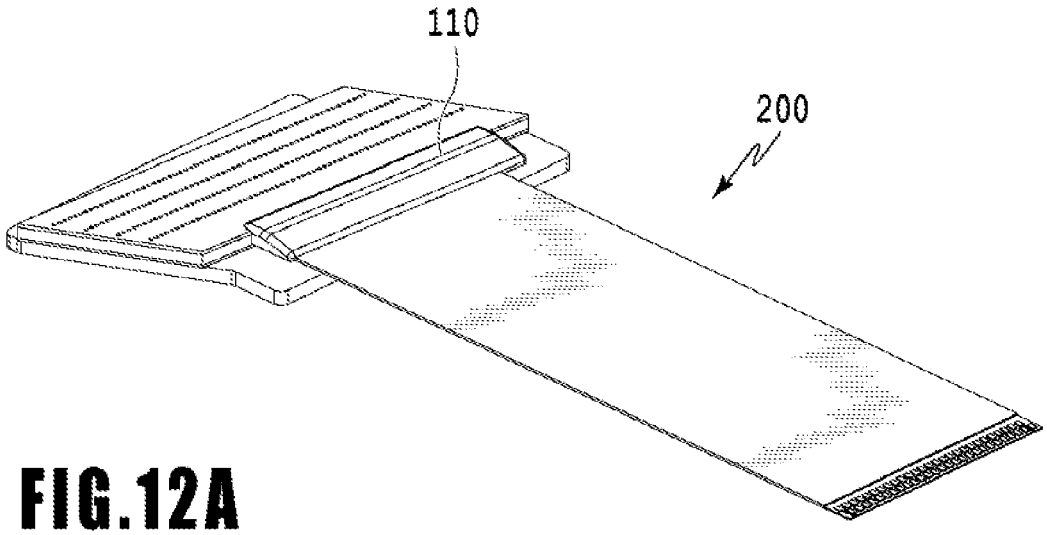
FIG. 12A is a perspective view illustrating an ejection module.
Figure 12B:
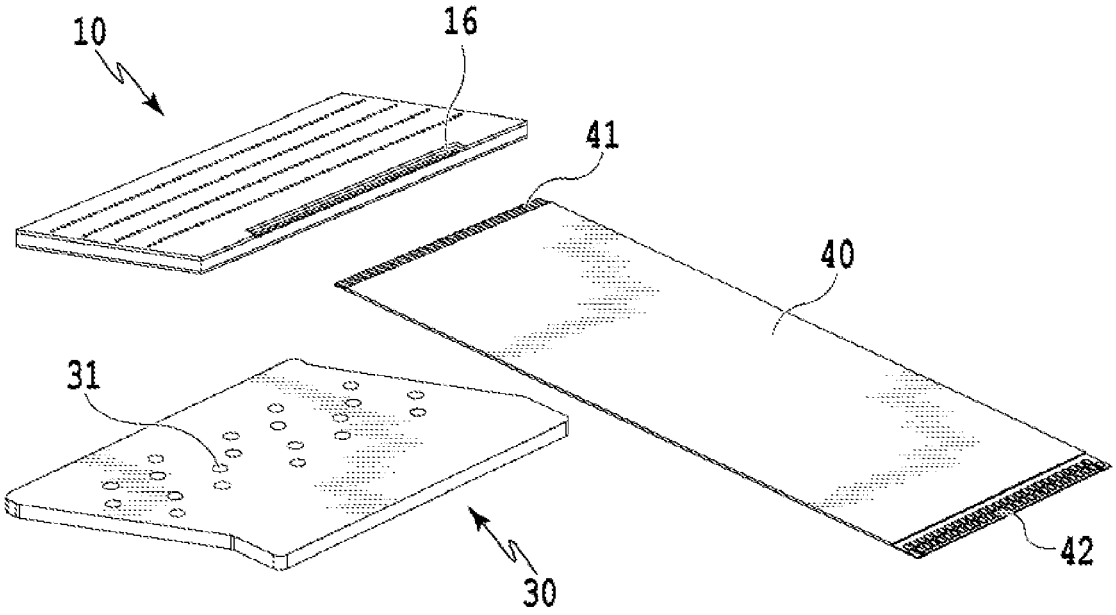
FIG. 12B is an exploded view of the ejection module.

FIG. 12A is a perspective view illustrating one of the ejection modules 200, and FIG. 12B is an exploded view thereof. According to a manufacturing method of the ejection module 200, the printing element substrate 10 and a flexible wiring substrate 40 are first adhered on the support member 30 having a liquid communication port 31 preliminarily provided thereon. Subsequently, a terminal 16 on the printing element substrate 10 and a terminal 41 on the flexible wiring substrate 40 are electrically connected by wire bonding, and a wire bonding unit (electrical connection unit) is covered and sealed with a sealing member 110 thereafter. A terminal 42 on the opposite side of the printing element substrate 10 of the flexible wiring substrate 40 is electrically connected to a connection terminal 93 (see FIG. 8) of the electric wiring substrate 90. The support member 30 is a supporting body that supports the printing element substrate 10, and also a flow path member that brings the printing element substrate 10 and the flow path member 210 in fluid communication, and therefore it is preferred to have a high flatness and be joinable with the printing element substrate with a sufficiently high reliability. For example, alumina or resin materials are preferred as the material thereof.

(Description of Structure of Printing Element Substrate)

Figure 13A:
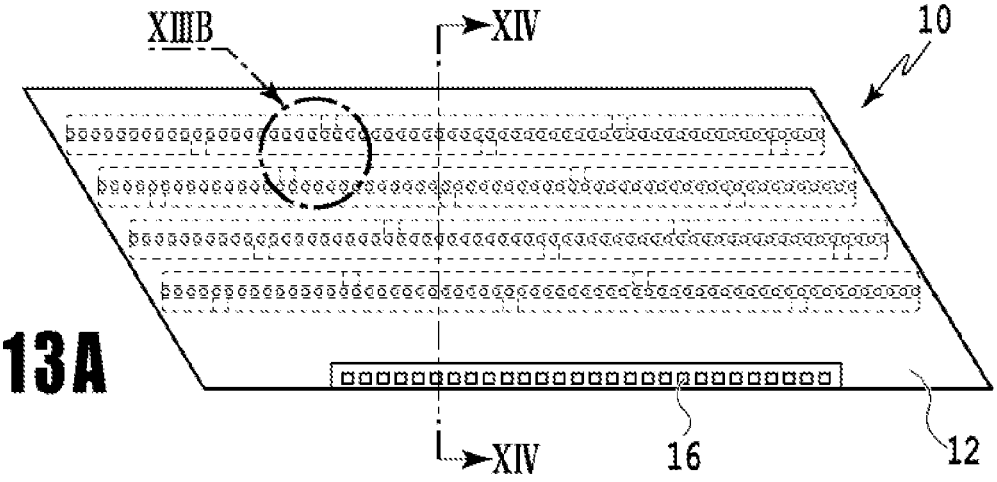
FIG. 13A illustrates the printing element substrate.
Figure 13B:
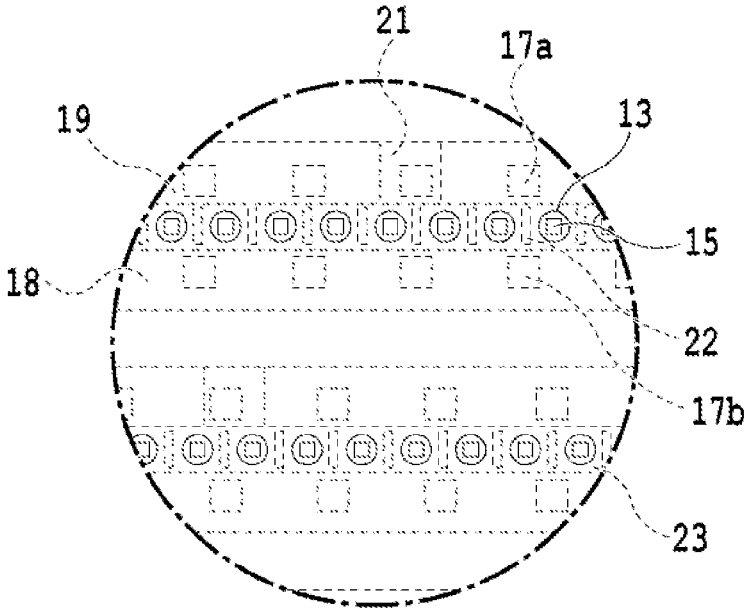
FIG. 13B illustrates the printing element substrate.
Figure 13C:
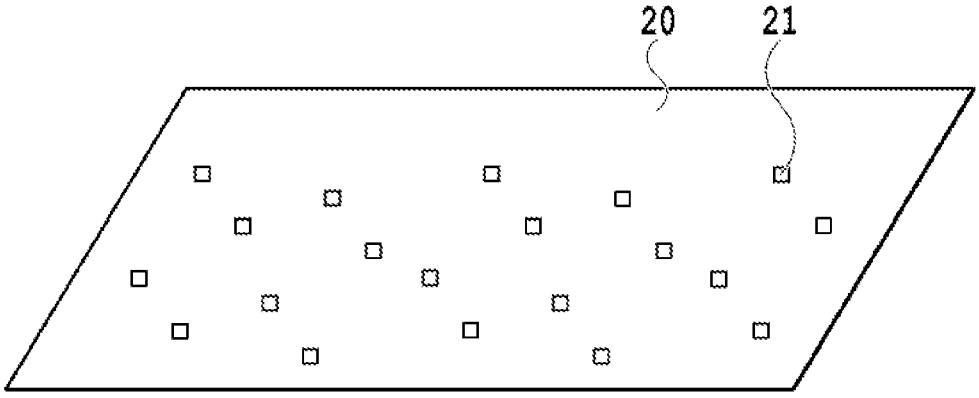
FIG. 13C illustrates the printing element substrate.

FIG. 13A illustrates a plan view of a surface of the printing element substrate 10 at the side on which ejection ports 13 are formed, FIG. 13B illustrates an enlarged view of the part indicated by "A" of FIG. 13A, and FIG. 13C illustrates a plan view of the back surface of FIG. 13A. Here, a configuration of the printing element substrate 10 in the present embodiment will be described. As illustrated in FIG. 13A, an ejection port forming member 12 of the printing element substrate 10 has formed thereon four columns of ejection ports corresponding to each ink color. Note that, in the following description, the direction in which the ejection port column including a plurality of the ejection ports 13 arranged therein extends is referred to as "ejection port column direction". A illustrated in FIG. 13B, the printing element 15, which is a heating element for causing the liquid to foam by heat energy, is provided at a position corresponding to each of the ejection ports 13. A pressure chamber 23 having the printing element 15 therein is separated by a partition wall 22.

The printing element 15 is electrically connected to the terminal 16 via electric wiring (not illustrated) provided on the printing element substrate 10. The printing element 15 is then heated to boil the liquid on the basis of pulse signals input from the control circuit of the printing apparatus 1000 via the electric wiring substrate 90 (see FIG. 8) and the flexible wiring substrate 40 (see FIG. 12B). Droplets are ejected from the ejection ports 13 by the force of foaming generated by the boiling. As illustrated in FIG. 13B, there are extending a liquid supply path 18 on one side and a liquid collection path 19 on the other side along each ejection port column. The liquid supply path 18 and the liquid collection path 19 are flow paths extending in the ejection port column direction provided on the printing element substrate 10, each in communication with the ejection ports 13 via supply ports 17*a* and collection ports 17*b*.

As illustrated in FIG. 13C, a sheet-shaped cover plate 20 is laminated on the back surface of the printing element substrate 10 on which the ejection ports 13 are provided, with the cover plate 20 having provided thereon a plurality of apertures 21 in communication with the liquid supply paths 18 and the liquid collection paths 19 described below. In the present embodiment, the cover plate 20 has provided thereon three of the apertures 21 for one of the liquid supply paths 18, and two of the apertures 21 for one of the liquid collection paths 19. As illustrated in FIG. 13B, each of the apertures 21 on the cover plate 20 is in communication with a plurality of communication ports 51 illustrated in the part (a) of FIG. 9. The cover plate 20 is preferred to have a sufficient corrosion resistance against liquid, and, from the viewpoint of preventing color mixing, a high precision is required for aperture shape and aperture position of the apertures 21. Accordingly, it is preferred to use a photosensitive resin material or a silicon substrate as the materials of the cover plate 20, and provide the apertures 21 by photolithography processing. As thus described, the cover plate 20 is intended to convert the pitch of the flow path using the apertures 21, and desired to be thin considering the pressure loss, and desired to be formed by a film-like member.

Figure 14:
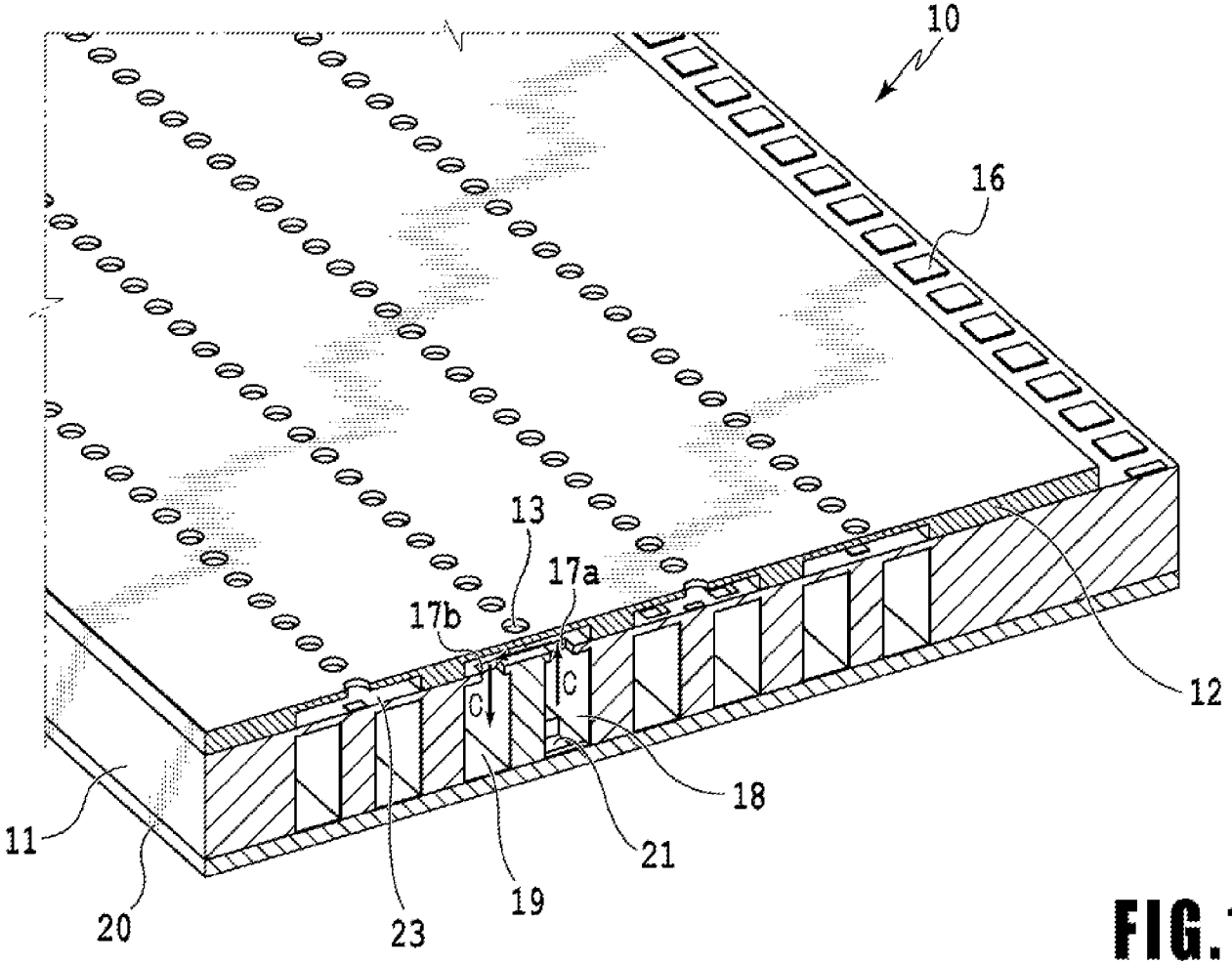
FIG. 14 is a perspective view illustrating a cross-section of the printing element substrate and a cover plate.

FIG. 14 is a perspective view illustrating a cross-section of the printing element substrate 10 and the cover plate 20 taken along XIV-XIV of FIG. 13A. Here, the flow of liquid in the printing element substrate 10 will be described. The cover plate 20 has a function as a cover forming a part of the wall of the liquid supply path 18 and the liquid collection path 19 formed on a substrate 11 of the printing element substrate 10. The printing element substrate 10 has laminated thereon the substrate 11 formed by Si and the ejection port forming member 12 formed by photosensitive resin, with the back surface of the substrate 11 having the cover plate 20 joined thereto. One surface of the substrate 11 has the printing element 15 formed thereon (see FIG. 13B), and the back surface thereof has formed thereon a groove forming the liquid supply path 18 and the liquid collection path 19 extending along the ejection port column. The liquid supply path 18 and the liquid collection path 19 formed by the substrate 11 and the cover plate 20 are respectively connected to the common supply flow path 211 and the common collection flow path 212 in the flow path member 210, generating a difference pressure between the liquid supply path 18 and the liquid collection path 19. In an ejection port which is not ejecting in the case where liquid is being ejected from the ejection ports 13 to perform printing, the difference pressure causes liquid in the liquid supply path 18 provided on the substrate 11 to flow to the liquid collection path 19 via the supply port 17*a*, the pressure chamber 23, and the collection port 17*b* (arrow C of FIG. 14).

The aforementioned flow, allows for collecting, into the liquid collection path 19, ink with increased viscosity, bubbles, or foreign matters generated by evaporation from the ejection ports 13 in the ejection ports 13 or the pressure chamber 23 pausing printing. In addition, it is possible to suppress increase of viscosity of the ink in the ejection ports 13 or the pressure chamber 23. The liquid collected into the liquid collection path 19 is collected from the apertures 21 of the cover plate 20 and the liquid communication port 31 of the support member 30 (see FIG. 12B) to the communication port 51, the individual collection flow path 214, and the common collection flow path 212, in the mentioned order, in the flow path member 210. Subsequently, the liquid is collected into the supply flow path of the printing apparatus 1000. In other words, the liquid supplied from the main body of the printing apparatus to the liquid ejection head 3 flows, and is supplied and collected in the following order.

The liquid first flows from the liquid connecting part 111 of the liquid supply unit 220 into the liquid ejection head 3. The liquid is then supplied in the order of: the joint rubber 100, the communication port 72 and a common flow path groove 71 provided on the third flow path member, the common flow path groove 62 and the communication pod 61 provided on the second flow path member, and the individual flow path groove 52 and the communication port 51 provided in the first flow path member. Subsequently, the liquid is supplied to the pressure chamber 23 via the liquid communication port 31 provided on the support member 30, the aperture 21 provided on the cover plate 20, the liquid supply path 18 provided on the substrate 11, and a supply port 17*a*, in the mentioned order. Of the whole of the liquid supplied to the pressure chamber 23, the portion of liquid which has not been ejected from the ejection port 13 flows in the order of the collection port 17*b* and the liquid collection path 19 provided on the substrate 11, the aperture 21 provided on the cover plate 20, and the liquid communication port 31 provided on the support member 30. Subsequently, the liquid flows in the order of the communication port 51 and the individual flow path groove 52 provided on the first flow path member, the communication port 61 and the common flow path groove 62 provided on the second flow path member, the common flow path groove 71 and the communication port 72 provided on the third flow path member 70, and the joint rubber 100. The liquid then flows from the liquid connecting part 111 provided on the liquid supply unit 220 to the outside of the liquid ejection head 3.

In the first circulation mechanism illustrated in FIG. 7A, the liquid which has flowed in from the liquid connecting part 111 is supplied to the joint rubber 100 via the negative pressure control unit 230. Additionally, in the second circulation mechanism illustrated in FIG. 7B the liquid collected from the pressure chamber 23 flows from the liquid connecting part 111 to the outside of the liquid ejection head, via the negative pressure control unit 230, after having passed the joint rubber 100. In addition, not all of the liquid which has flowed from one end of the common supply flow path 211 of the liquid ejection unit 300 is necessarily supplied to the pressure chamber 23 via the individual supply flow path 213. In other words, of the liquid which has flowed from one end of the common supply flow path 211, there exists a portion that flows from the other end of the common supply flow path 211 toward the liquid supply unit 220 without flowing into the individual supply flow path 213. As thus described, providing a path that lets liquid flow without passing through the printing element substrate 10 allows for suppressing backflow of circulating liquid even in the case where there exists the printing element substrate 10 having a fine flow path with a high flow resistance such as that in the present embodiment. As thus described, the liquid ejection head 3 of the present embodiment allows for suppressing increase of viscosity of liquid in the pressure chamber 23 or in the vicinity of ejection ports, whereby it is possible to suppress misdirected ejection or ejection failure and, as a result, perform printing with a high image quality.

(Description of Positional Relation Between Printing Element Substrates)

Figure 15:
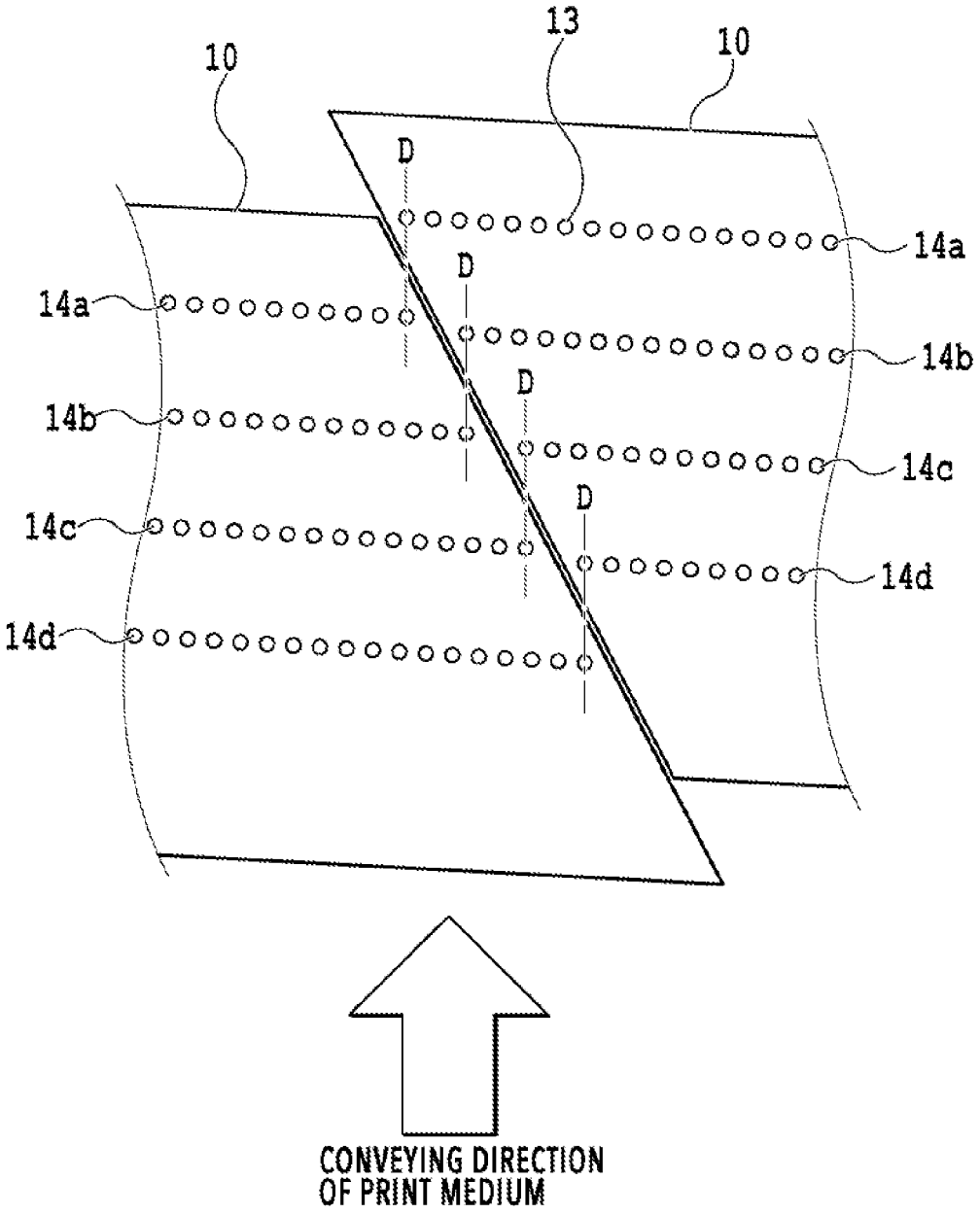
FIG. 15 is a plan view illustrating adjacent parts of the printing element substrate in a partially magnified manner.

FIG. 15 is a plan view illustrating, in a partially magnified manner, adjacent parts of the printing element substrate in two adjacent ejection modules. In the present embodiment, generally parallelogram printing element substrate is used. Each of the ejection port columns (14*a* to 14*d*) in which the ejection ports 13 in each of the printing element substrates 10 are arranged is provided so as to be inclined at a certain angle relative to the conveying direction of the print medium. The ejection port column in the adjacent part between the printing element substrates 10 is then arranged so that at least one of the ejection ports overlaps in the conveying direction of the print medium. In FIG. 15, two ejection ports on a line D are in an overlapping relation with each other. Such an arrangement allows for making black streaks or white spots in a printed image less outstanding by drive control of overlapping ejection ports, even in the case where the position of the printing element substrate 10 has more or less deviated from a predetermined position. Also in the case where a plurality of printing element substrates 10 are provided over a straight line (in-line) instead of a staggered arrangement, the configuration illustrated in FIG. 15 allows for addressing black streaks or white spots in the joint part between the printing element substrates 10, while suppressing increase of the length of the liquid ejection head in the conveying direction of the print medium. Note that, although the main plane of the printing element substrate is a parallelogram in the present embodiment, the configuration is not limited thereto, and may also be preferably applied in the case of using a printing element substrate which is, for example, rectangular, trapezoidal, or of other shapes.

(Description of Configuration of Printing Element Substrate)

Figure 16A:
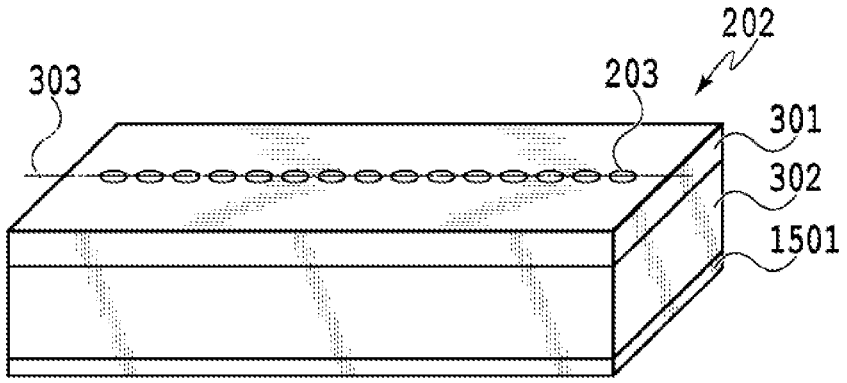
FIG. 16A is an explanatory diagram of an exemplary configuration of the printing element substrate in the print head.
Figure 16B:
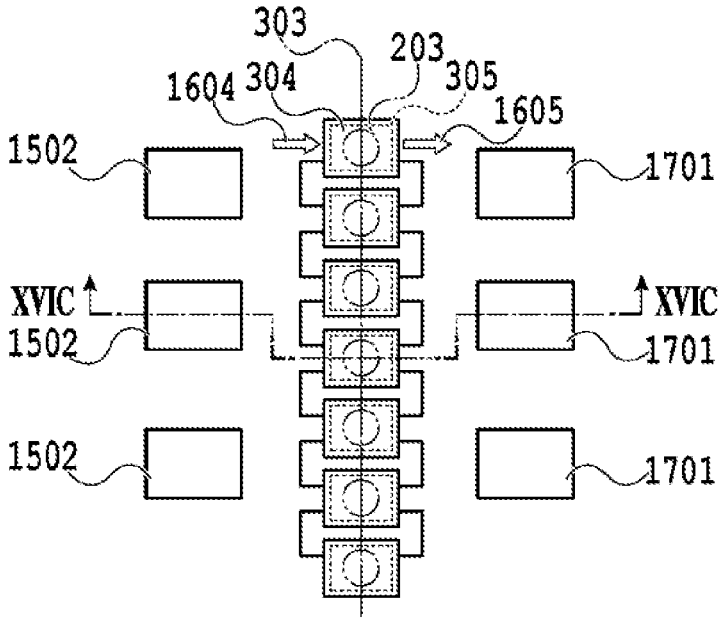
FIG. 16B is an explanatory diagram of an exemplary configuration of the printing element substrate in the print head.
Figure 16C:
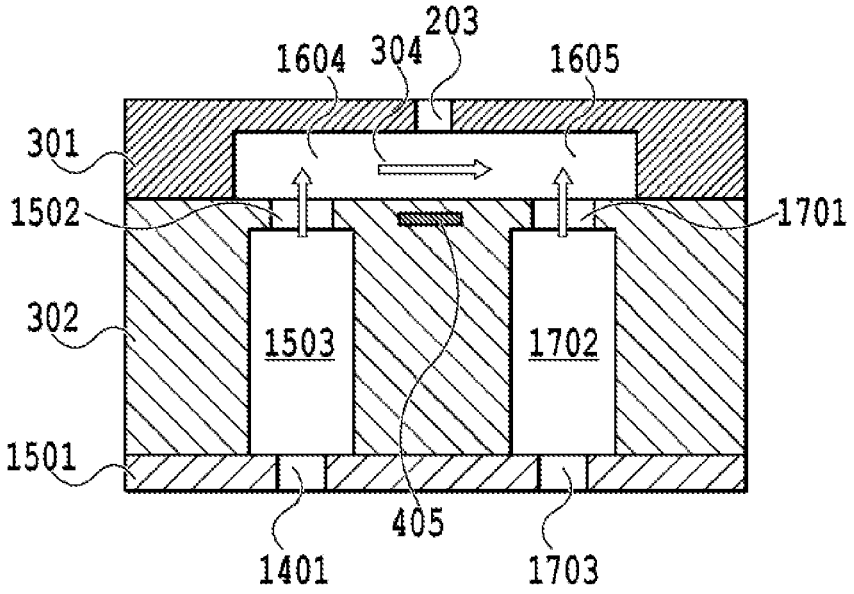
FIG. 16C is an explanatory diagram of an exemplary configuration of the printing element substrate in the print head.

FIGS. 16A to 16C are explanatory diagrams of an exemplary configuration of the printing element substrate 202 in the print head 102. FIG. 16A is a perspective view of the printing element substrate 202 of the present embodiment, with the orifice plate 301 joined on the substrate 302. The orifice plate 301 has plurality of the ejection ports 203 provided thereon, the ejection ports 203 thereof forming ejection port column 303. The front surface of the substrate 302 may have ejection energy generating elements, electric circuits, electric wiring, and electronic devices such as a temperature sensor provided thereon by semiconductor processing, and therefore a material such as a semiconductor substrate on which a flow path may be formed by MEMS processing is desirable as the material of the substrate 302. Any material may be employed as the material of the orifice plate 301. For example, a resin substrate on which ejection ports may be formed by laser processing, an inorganic plate on which ejection ports may be formed by dicing, a photosensitive resin material on which ejection ports and a flow path may be formed by light curing, and a semiconductor substrate on which ejection ports and a flow path may be formed by MEMS processing, or the like may be used.

FIG. 16B is an enlarged perspective view of the printing element substrate 202 seen from the orifice plate 301 side. The pressure chamber 304 is formed in the space between the substrate 302 and the orifice plate 301, and the ejection energy generating element 305 for ejecting ink from the ejection port 203 is installed at a position of the substrate 302 facing the ejection port 203. An electro-thermal conversion element (heater) or a piezoelectric element may be used as the ejection energy generating element 305. The pressure chamber 304 has ink supplied thereto through a vertical supply port 1502. FIG. 16C is a cross-sectional view taken along the line XVIC-XVIC of the printing element substrate 202 of FIG. 16B. The pressure chamber 304 has fluidly connected thereto an inflow path 1604 and an outflow path 1605, forming a series of flow paths. Therefore, ink flows from the inflow path 1604 through the pressure chamber 304 toward the outflow path 1605. The vertical supply port 1502 and a vertical ejection port 1701 penetrate the substrate 302, respectively in communication with the inflow path 1604 and the outflow path 1605. In addition, an inflow-side back surface flow path 1503 in communication with the vertical supply port 1502, and an outflow-side back surface flow path 1702 in communication with the vertical ejection port 1701 are respectively in communication with an inflow-side aperture 1401 and an outflow-side aperture 1703 of a cover plate 1501.

In the present embodiment, a circulation path of ink is formed, and ink is ejected from the ejection port 203 by driving the ejection energy generating element 305 in a state where a flow of ink from the inflow path 1604 toward the outflow path 1605 has been generated. Performing an ink ejection operation in a state where a flow of ink from the inflow path 1604 toward the outflow path 1605 has been generated, has little effect in the landing precision of ink droplets.

(Pressure Loss in Ink Supply System)

Figure 17:
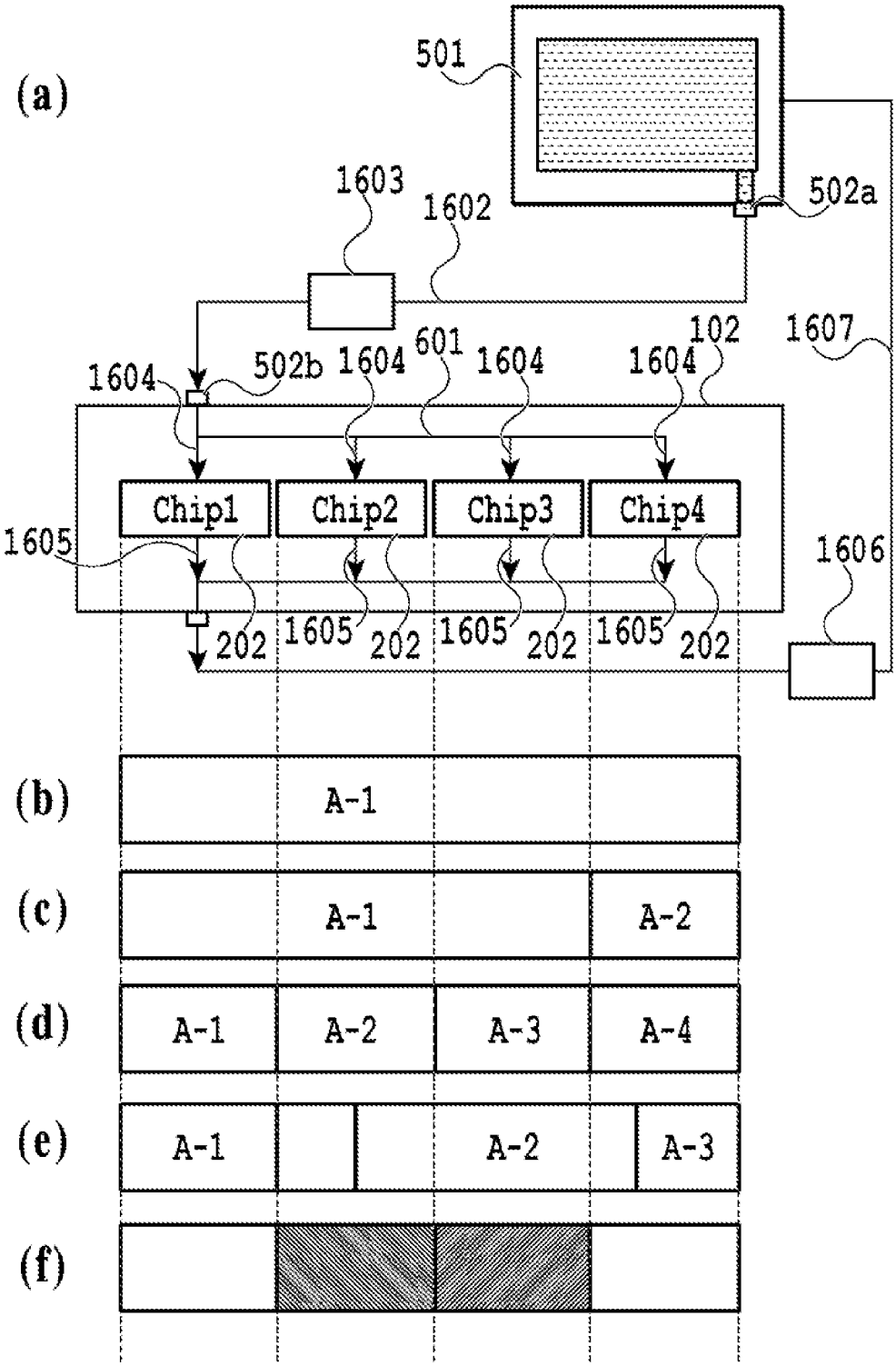
FIG. 17 illustrates monitoring areas corresponding to an ink supply system and priming elements of the printing apparatus.

The part (a) of FIG. 17 illustrates an ink supply system of the printing apparatus 1000 in the case where the printing element substrate 202 has the configuration of FIG. 16, with the parts (b) to (f) illustrating monitoring areas corresponding to the printing elements. Ink in the main tank 501 is supplied to the print head 102 through an ink supply flow path 1602. A part of the ink supplied to the print head 102 is ejected from the ejection port 203, and the rest of the ink is collected into the main tank 501 through an ink collection flow path 1607. A negative pressure regulator 1603 included in the ink supply flow path 1602 and a constant flow pump 1606 included in the ink collection flow path 1607 regulate the pressure of ink at the ejection ports 203, while generating a circulating flow of ink between an ink tank 1601 and the print head 102. The constant flow pump 1606 and the negative pressure regulator 1603 that generate a circulating flow of ink may be integrally provided with the print head 102, or alternatively may be provided outside of the print head 102 and connected to the print head 102 via a supply tube or the like. In addition, they may also be incorporated within the printing element substrate as a MEMS element such as a micro-pump.

(Exemplary Control of Ink Flow Amount)

The present embodiment is different from the first embodiment in that not only the inflow path 1604 but also the outflow path 1605 is affected by the pressure loss. Setting of monitoring areas is performed similarly to the first embodiment considering the effect on the outflow path 1605.

Third Embodiment

In the following, a third embodiment of the present invention will be described, referring to the drawings. Since the basic configuration of the present embodiment is similar to the first embodiment, only characteristic components will be described below.

The present embodiment sets monitoring areas in accordance with the positions of the apertures 21 of the cover plate 20 included in the printing element substrate. The configurations of the printing apparatus 101 and the control system are similar to those of the first and the second embodiments.

(Pressure Loss in Ink Supply System)

Although the printing element substrate in the present embodiment is assumed to have a circulation path of ink formed therein similarly to the second embodiment, this is not limiting and a supply configuration without circulation may be employed as illustrated in the first embodiment. Here, a reason will be described why shortage of supply to the ejection port located at the end of the printing element substrate is concerned in the configuration where ink flows from the inflow-side aperture through the ejection port toward the outflow-side aperture.

As illustrated in FIG. 14, the printing element substrate is configured so that ink circulates from the aperture 21 of the cover plate 20 via the liquid supply path 18, the pressure chamber 23, and the liquid collection path 19. Since the flow path length of the liquid supply path 18 or the liquid collection path 19 from the aperture 21 located at the end of the ejection port 13 in the arrangement direction to the ejection port 13 located at the end thereof turns out to be long, the pressure loss increases in accordance therewith. Additionally, in the case of ejecting ink from a plurality of ejection ports 13, also the increase of the ink flow amount in the liquid supply path 18 or the liquid collection path 19 turns out to be a factor of increasing the pressure loss. Therefore, it is necessary to control the flow amount for each printing element substrate, taking into account the effect of pressure loss in the flow path length of the liquid supply paths 18 and the liquid collection path 19 from the aperture 21 to the ejection port 13. Although the print duty threshold value Dt from the upstream to the downstream of the aperture may be set equally in the case where pressure loss in the liquid supply path 18 and the liquid collection path 19 is very small, the print duty threshold value Dt from the upstream to the downstream is set smaller in the case where pressure loss is large.

(Exemplary Control of Ink Flow Amount)

Figure 18:
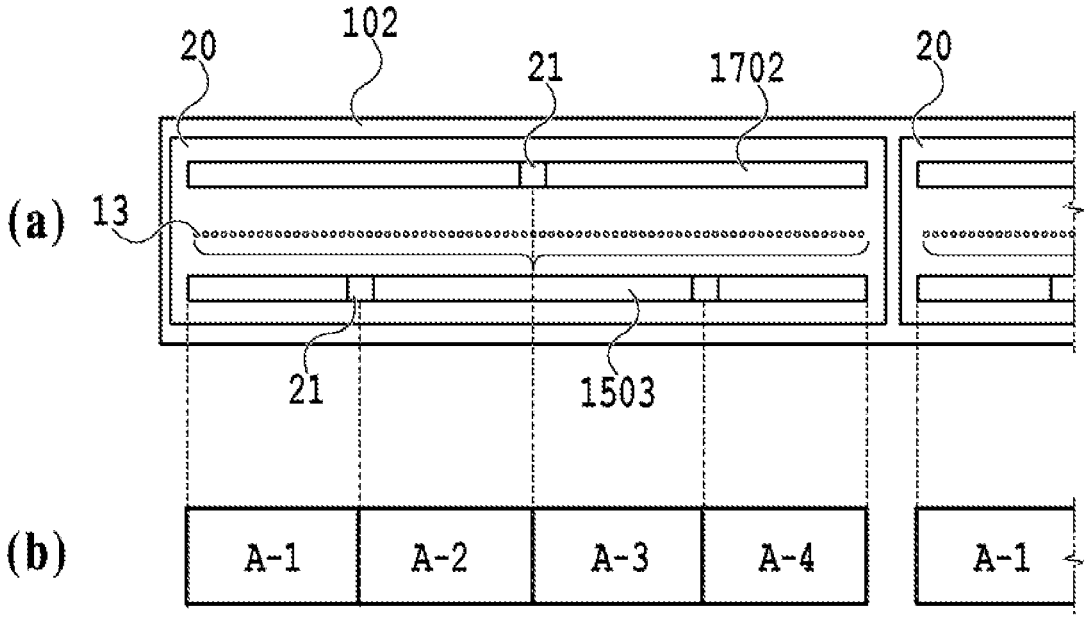
FIG. 18 illustrates monitoring areas of the ink flow amount in the printing element substrate.

FIG. 18 illustrates monitoring areas of the ink flow amount in the print head 102. In the present embodiment, the monitoring areas are divided on the basis of the apertures 21 of the cover plate 20 of the printing element substrate as illustrated in the part (a) of FIG. 18. The number of the apertures 21 of the cover plate 20 is three in the present embodiment, and therefore number of divided areas turns out to be four, as illustrated in the part (b) of FIG. 18. However, the manner of division is not limited thereto.

Fourth Embodiment

In the following, a fourth embodiment of the present invention will be described, referring to the drawings. Since the basic configuration of the present embodiment is similar to the first embodiment, only characteristic components will be described below.

The present embodiment is different from the first to the third embodiments in that a plurality of types of monitoring areas are set.

(Exemplary Control of Ink Flow Amount)

Figure 19:
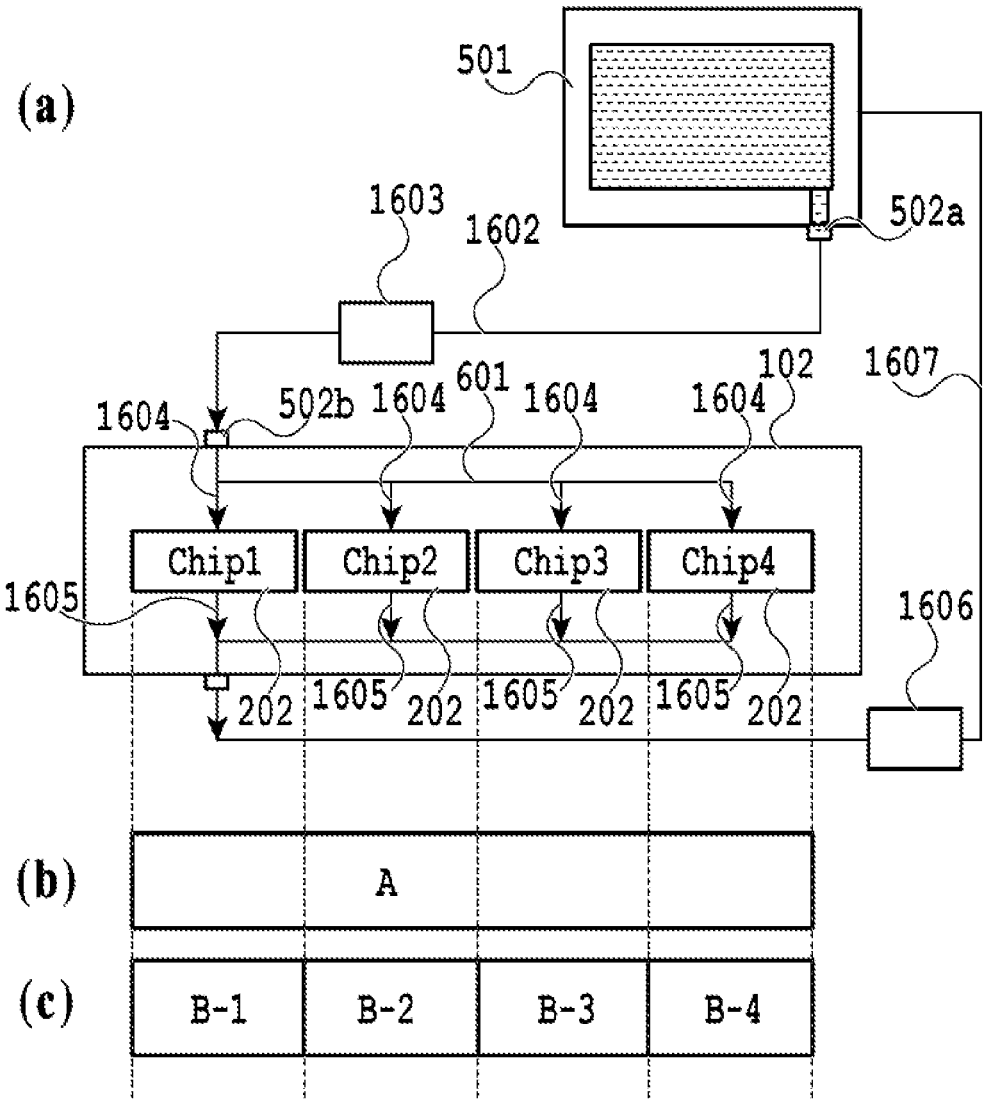
FIG. 19 illustrates monitoring areas of the ink flow amount of the present embodiment.

FIG. 19 illustrates monitoring areas of the ink flow amount of the present embodiment. The part (a) of FIG. 19 is similar to the second embodiment, illustrating a configuration with ink circulating between the print head and the ink tank. The parts (b) and (c) of FIG. 19 illustrate monitoring areas corresponding to the printing element substrate in the present embodiment.

Here, for convenience of explanation, similarly to the first and the second embodiments, there is proposed a configuration having four printing element substrates, namely the Chip 1 to the Chip 4, in the print head 102. In addition, as illustrated in the part (b) of FIG. 19, the first monitoring area is assumed to be a monitoring area A of the entire print head, and the second monitoring area is assumed to be monitoring areas B-1, B-2, B-3 and B-4 set for respective printing element substrates as illustrated in the part (c) of FIG. 19. As thus described, two types of monitoring areas are set in the present embodiment.

Setting four monitoring areas for each printing element substrate as illustrated in the part (c) of FIG. 19 and performing determination of the control of flow amount leads to determination of pressure loss calculated from only the flow amount of individual printing element substrates. In comparison with the monitoring area covering the entire print head as illustrated in the part (b) of FIG. 19, the part (c) of FIG. 19 indicates an increased flow amount in the inflow-side common flow path 601 and the out-flow side common flow path 602, because the four printing element substrates are performing printing simultaneously. Therefore, the pressure loss turns out to be larger than that calculated from only the flow amount of a single printing element substrate.

As thus described, the effect of pressure loss due to increase of flow amount is not taken into account in the case of setting monitoring areas for each printing element substrate. Therefore, since the pressure loss increases in the case of performing printing simultaneously on a plurality of printing element substrates, there is a concern that printing non-uniformity may occur even in a lighter image than the print duty acceptable on a single printing element substrate. On the other hand, there is a concern of excessively controlling the flow amount by setting the print duty threshold value Dt taking into account the pressure loss in the case of driving a plurality of printing element substrates.

Accordingly, in the present embodiment, taking into account the aforementioned situation, the print duty threshold value Dt in the second monitoring areas B-1, B-2, B-3 and B-4 is set in accordance with the flow amount and the pressure loss calculated from the dot count in the first monitoring area A. Therefore, having taken into account the pressure loss variation due to the total dot count, it becomes possible to perform control for each printing element substrate.

In the present embodiment, although the first monitoring area is assumed to cover the entire print head, and the second monitoring area is assumed to cover each printing element substrate, the setting method of monitoring areas is not limited thereto. In addition, the number of types of setting monitoring areas is not limited to two as described in the present embodiment, and there may be more than two types.

In addition, although the flow amount is controlled by calculating pressure loss in the print head and determining whether it is larger or smaller than a threshold value in the present embodiment, the threshold value is also not limited thereto. For example, control may be performed using electric power, curl of paper, or roller transfer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-068665 filed Mar. 30, 2018, which is hereby incorporated by reference herein in its entirety.

What is claimed is:

1. An image forming apparatus comprising:

an ejection head including a first printing element substrate, a second printing element substrate, and a third printing element substrate, wherein the first printing element substrate, the second printing element substrate, and the third printing element substrate, collectively, include (a) an ejection port array in which a plurality of ejection ports for ejecting liquid are arranged and (b) a flow path for supplying liquid to the plurality of ejection ports, and wherein the ejection head further includes a liquid connecting part for supplying liquid to the flow path; and a control unit configured to control the amount of liquid to be ejected from the plurality of ejection ports, wherein the plurality of ejection ports include (a) a plurality of first ejection ports supplied with a first pressure loss from the liquid connecting part through the flow path and (b) a plurality of second ejection ports supplied with a second pressure loss larger than the first pressure loss, wherein a first threshold value, which is a threshold value of an ejection amount per unit time ejected from the plurality of first ejection ports, is set to the plurality of first ejection ports, wherein a second threshold value, which is a threshold value of an ejection amount per unit time ejected from the plurality of second ejection ports and which is smaller than the first threshold value, is set to the plurality of second ejection ports, and wherein the control unit controls so that (a) the ejection amount ejected from each of the plurality of first ejection ports per unit time is equal to or less than the first threshold value and (b) the ejection amount ejected from each of the plurality of second ejection ports per unit time is equal to or less than the second threshold value, and wherein the plurality of first ejection ports is provided on the first printing element substrate and the second printing element substrate, the plurality of second ejection ports is provided on the second printing element substrate and the third printing element substrate, the first threshold value is set for all of the ejection ports provided on the first printing element substrate, and the second threshold value is set for all of the ejection ports provided on the third printing element substrate.

2. The image forming apparatus according to claim 1, wherein the control unit performs control so that the amount of liquid to be ejected per unit time from the first ejection port is equal to or smaller than the first threshold value, in a case where, as a result of comparing the amount of liquid to be ejected from the first ejection port with the first threshold value, the amount of liquid to be ejected from the first ejection port is larger than the first threshold value, and wherein the control unit performs control so that the amount of liquid to be ejected per unit time from the second ejection port is equal to or smaller than the second threshold value, in a case where, as a result of comparing the amount of liquid to be ejected from the second ejection port with the second threshold value, the amount of liquid to be ejected from the second ejection port is larger than the second threshold value.

3. The image forming apparatus according to claim 1, wherein the control unit performs control so that the amount of liquid to be ejected per unit time from the first ejection port becomes equal to or smaller than the first threshold value by reducing an ejection frequency of ejecting liquid from the first ejection port, and wherein the control unit performs control so that the amount of liquid to be ejected per unit time from the second ejection port becomes equal to or smaller than the second threshold value by reducing an ejection frequency of ejecting liquid from the second ejection port.

4. The image forming apparatus according to claim 1, further comprising a conveying unit configured to convey a print medium on which an image is formed by liquid ejected from the first ejection port, wherein the control unit performs control so that the amount of liquid to be ejected per unit time from the first ejection port becomes equal to or smaller than the first threshold value by reducing conveying speed of the print medium by the conveying unit, and wherein the control unit performs control so that the amount of liquid to be ejected per unit time from the second ejection port becomes equal to or smaller than the second threshold value by reducing conveying speed of the print medium by the conveying unit.

5. The image forming apparatus according to claim 1, wherein the first threshold value is set in accordance with environmental temperature.

6. The image forming apparatus according to claim 1, wherein the amount of ejected liquid for the first ejection port controlled by the control unit is the number of droplets to be ejected from the first ejection port, wherein the amount of ejected liquid for the second ejection port controlled by the control unit is the number of droplets to be ejected from the second ejection port, and wherein the image forming apparatus further comprises a calculating unit configured to calculate the number of droplets to be ejected from the first ejection port and the number of droplets to be ejected from the second ejection port, on the basis of ejection data for causing liquid to be ejected from the first ejection port and ejection data for causing liquid to be ejected from the second ejection port, respectively.

7. The image forming apparatus according to claim 1, further comprising:

a tank capable of storing liquid and configured to supply liquid to the ejection head; and a circulation unit configured to circulate liquid between the tank and the ejection head.

8. The image forming apparatus according to claim 7, wherein the first ejection port is provided on a substrate, and wherein an area where the first ejection port is provided is set in accordance with positions of a first aperture for supplying liquid to the first ejection port and a second aperture for collecting liquid from the first ejection port on a plate included in the substrate.

9. The image forming apparatus according to claim 1, wherein the first printing element substrate, the second printing element substrate, and the third printing element substrate are arranged in a straight line in this order.

* * * * *